US012565297B2

(12) United States Patent
Garthwaite et al.

(10) Patent No.: US 12,565,297 B2
(45) Date of Patent: Mar. 3, 2026

(54) ROBOTIC FISH

(71) Applicant: Fishboat Incorporated, Bainbridge Island, WA (US)

(72) Inventors: Martin Spencer Garthwaite, Bainbridge Island, WA (US); Kirk O'Donnell, Bainbridge Island, WA (US)

(73) Assignee: Fishboat Incorporated, Bainbridge Island, WA (US)

( * ) Notice: Subject to any disclaimer, the term of this patent is extended or adjusted under 35 U.S.C. 154(b) by 478 days.

(21) Appl. No.: 18/106,292

(22) Filed: Feb. 6, 2023

(65) Prior Publication Data

US 2023/0182877 A1 Jun. 15, 2023

Related U.S. Application Data

(63) Continuation of application No. PCT/US2021/045245, filed on Aug. 9, 2021.
(Continued)

(51) Int. Cl.
*B63H 1/36* (2006.01)
*B63G 8/00* (2006.01)
(Continued)

(52) U.S. Cl.
CPC ..... *B63H 1/36* (2013.01); *B63H 1/37* (2013.01); *B63H 21/17* (2013.01); *B63H 23/00* (2013.01); *B63G 2008/002* (2013.01)

(58) Field of Classification Search
CPC .... B63G 2008/002; B63H 19/08; B63H 1/36; B63H 1/37; B63H 21/17; B63H 23/00; Y02T 90/40
See application file for complete search history.

(56) References Cited

U.S. PATENT DOCUMENTS 5,063,336 A * 11/1991 Atlas ..... F16C 32/0444 244/165
5,237,952 A * 8/1993 Rowe ..... B63G 8/12 114/280
(Continued)

FOREIGN PATENT DOCUMENTS

CN 101643113 A * 2/2010
CN 102632984 A * 8/2012
CN 203902830 U * 10/2014

OTHER PUBLICATIONS

New Bearing Cage Extends Life of Cylindrical Roller Bearings by More than 20 percent—Jul. 2012 (Year: 2012).*

*Primary Examiner* — Brian Christopher Delrue
(74) *Attorney, Agent, or Firm* — Martin Spencer Garthwaite

(57) ABSTRACT

A robotic fish comprises one or more torque reaction engines and a fin, wherein the one or more torque reaction engines cyclically oscillate and is to cause one or more waves to propagate through the fin, wherein the one or more waves accelerating thrust fluid and propel the robotic fish. The robotic fish may have a shape of a flagellum, a fish, a marine mammal, or a disc. The one or more of the one or more torque reaction engines may comprise a drive shaft or may comprise no drive shaft. When the one or more of the one or more torque reaction engines comprises no drive shaft, the one or more of the one or more torque reaction engines may comprise a bearing surface of a closed ball-and-socket joint.

17 Claims, 20 Drawing Sheets

Related U.S. Application Data

(60) Provisional application No. 63/062,777, filed on Aug. 7, 2020.

(51) Int. Cl.
*B63H 1/37* (2006.01)
*B63H 21/17* (2006.01)
*B63H 23/00* (2006.01)

(56) References Cited

U.S. PATENT DOCUMENTS 6,814,634 B2 * 11/2004 Roberts ..... B63H 11/08 440/38
6,835,108 B1 * 12/2004 Gieseke ..... B63H 1/30 440/14
9,032,900 B2 * 5/2015 Glezer ..... B63G 8/14 114/321
10,931,164 B1 * 2/2021 Westfall ..... H02K 7/1846
11,005,336 B1 * 5/2021 Khatri ..... F16C 32/0493
11,845,522 B2 * 12/2023 Garthwaite ..... B63H 1/37
12,151,788 B2 * 11/2024 Garthwaite ..... B63H 1/36
12,269,567 B2 * 4/2025 Garthwaite ..... B63G 8/18
12,331,783 B2 * 6/2025 Ota ..... F16C 32/0465
2001/0013733 A1 * 8/2001 Schob ..... F16C 32/0457 310/90.5
2001/0030471 A1 * 10/2001 Kanebako ..... F16C 32/0493 310/156.01
2008/0032849 A1 * 2/2008 Briscoe ..... F16C 19/30 475/331
2008/0087762 A1 * 4/2008 Holloman ..... B64U 10/30 244/30
2010/0151751 A1 * 6/2010 Jemt ..... B63H 1/36 440/14
2016/0304179 A1 * 10/2016 Garthwaite ..... B63B 21/56
2018/0281913 A1 * 10/2018 Garthwaite ..... B63G 8/08
2018/0312234 A1 * 11/2018 Garthwaite ..... B63C 11/46
2019/0135393 A1 * 5/2019 Pieterkosky ..... B63B 35/44
2019/0152573 A1 * 5/2019 Wiens ..... B63G 8/001
2019/0351986 A1 * 11/2019 Garthwaite ..... B63B 21/56
2020/0255108 A1 * 8/2020 Garthwaite ..... B63G 8/08
2020/0407060 A1 * 12/2020 Hosseini ..... B64C 13/38
2022/0033043 A1 * 2/2022 Garthwaite ..... B63H 1/36
2022/0041263 A1 * 2/2022 Rainville ..... B64U 50/19
2025/0066002 A1 * 2/2025 Garthwaite ..... B63H 1/37

* cited by examiner

ROBOTIC FISH

CROSS REFERENCE TO RELATED APPLICATIONS

This application is a continuation of PCT application number PCT/US2021/045245, filed 2021 Aug. 9, which application is a non-provisional of, claims the benefit of the filing date of, and incorporates by this reference the subject matter of U.S. provisional patent application Ser. No. 63/062,777, filed Aug. 7, 2020.

BACKGROUND

Heretofore, propeller driven craft and robotic fish have many parts including, for example, propellers, steering mechanisms, vertebrae, multiple motors, gears, lever arms, push rods, power transfer wires, hydraulic actuators, pumps, lines, and the like. Many of these parts require a power source to operate, comprise bearings exposed to water, comprise moving bearing surfaces sealed against entry of water (such as a driveshaft seal in a hull). Many of these parts are expensive to design, fabricate, and assemble, are vulnerable to failure, and are difficult and or expensive to maintain. Many of these parts are a drag on overall efficiency of watercraft.

Many propeller driven craft, such as torpedoes, robotic fish, and sea gliders cannot be operated in, on, or in contact with environments, such as an ocean floor, pilings, industrial facilities, or sewer pipes or other environments that are slimy, muddy, viscous, contain filaments (such as sea grass, sea weed, fishing lines, nets, rope, and the like), are rocky, are sandy, have piers, are discontinuous, and or do not provide open space around the craft in order to for the craft to propel itself, steer, and operate safely and reliably. Many propeller driven craft, robotic fish, and sea gliders have multiple mechanisms to move in different directions, such as multiple fins, mechanisms to effect yaw, roll, and attitude, and the like, many of which involve one or more actuators, wherein the actuators must be sealed against entry of water.

Aerial quadcopter drones typically comprise four or more propellers and can rapidly change direction or rotate by vectoring lift and thrust from the propellers, without external steering components, other than the propellers. Aerial quadcopter drones have a lower top speed and range compared to fixed wing craft, because aerial quadcopters have relatively more drag and less efficient lift production compared to fixed wing craft. However, the top speed and range of quadcopters is serviceable, on the order of one-half to one hour or more over five to ten miles for professional, more expensive, quadcopters. As a result, quadcopters dominate the market for aerial drones, because, in addition to having reasonable top speed and range, they are extremely maneuverable, they can hover, turn, take-off and land, and course correct in a compact area, they can carry a wide range of sensors, and because they can carry and deliver payloads in a flexible manner.

Many autonomous propeller driven watercraft, such as torpedoes and sea gliders have limited maneuverability and require multiple body lengths of travel to complete a turn. A subset of remotely operated vehicles, autonomous propeller driven watercraft, boats, and submarines have multiple propellers oriented in different directions, are capable of producing vectored thrust using such multiple propellers, and are more maneuverable than torpedoes and sea gliders, though such watercraft have lower relative hydrodynamic efficiency compared to craft without vectored thrust, are slow moving, have limited deployment time, require frequent maintenance of sealed components and maintenance of components within tight operating tolerances, and or may require a tether to provide power and control signals to the watercraft. The physical and logical complexities of this subset of watercraft limit their use to subsea applications which require maneuverability over a short distance, such as to manipulate valves of a subsea oil well, and where power can be supplied by a tether or where limitations on horizontal travel or total deployment time can be tolerated. Though maneuverable, this subset of watercraft cannot be fairly compared to aerial quadcopter drones, which are both highly maneuverable and have reasonable or serviceable range and deployment time.

Even if optimized for travel over distance, many autonomous subsea propeller driven craft and robotic fish have deployment times on the order of two or three days or less, have operating depths limited by sealed components, have limited efficiency, have limited maneuverability, and or must be serviced frequently.

Needed is a watercraft which has few total number of moving parts, few sealed moving components, which can be operated in, on, or in contact with mucky or viscous environments such as the ocean floor and the interior of sewer pipes, which is robust, resists entanglement, which can tolerate contact with solid objects such as piers, rocks, sand, and the like, which can be operated at depths not determined by limitations of sealed moving components, which may have a relatively high overall efficiency, which may be reliable, which may be highly maneuverable, and which may have a reasonable or serviceable range and deployment time.

SUMMARY

Figure 1:
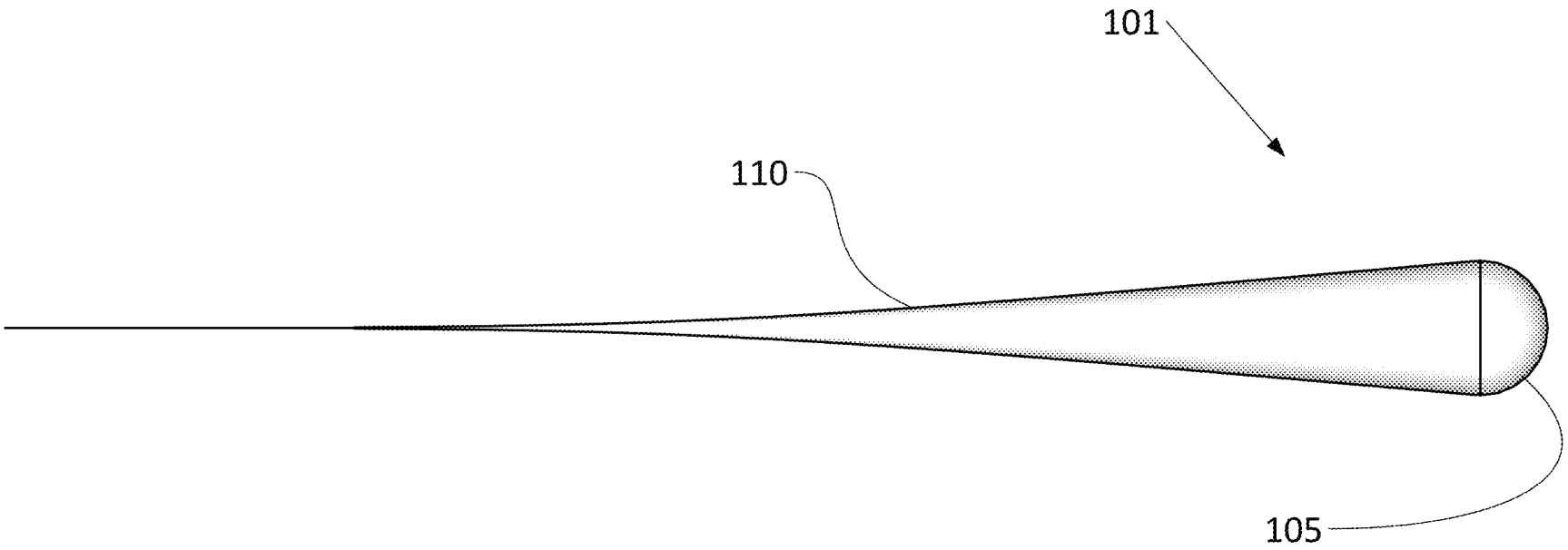
FIG. 1 illustrates a side elevation of a robotic fish comprising a torque reaction engine and a fin in the form of a flagellum, in accordance with an embodiment.

Disclosed is a robotic fish comprising a fin and one or more torque reaction engines ("TREs") secured to the fin, wherein the one or more TREs are to cause the fin to translate or rotate through and transfer momentum to a surrounding thrust fluid, wherein the one or more TREs comprise a first set of magnets, a second set of magnets, and an inertial mass, wherein at least one of the first set of magnets and the second set of magnets are electronically controlled by an electronic motor control module to transfer a torque between a first group and a second group, wherein the first group comprises the first set of magnets and the fin and the second group comprises the second set of magnets and the inertial mass. The second group may float within the first group. The second group may float within the first group on a bearing.

The bearing may comprise at least one of a bearing surface of a closed ball-and-socket joint, a magnetic bearing, a rolling bearing, or a gimbal. When the bearing comprises the bearing surface of the closed ball-and-socket joint, the TRE may not comprise a driveshaft. When the bearing comprises the magnetic bearing, the rolling bearing, or the gimbal, the TRE may or may not comprise a driveshaft. The rolling bearing may comprise a bearing cage. The gimbal may allows the second group at least one degree of freedom of motion relative to the first group. The magnetic bearing may comprise a permanent magnet and an electromagnet, and wherein to float comprises the permanent magnet suspending the second group in a desired position within the first group and the electromagnet correcting deviations of second group from a desired position and transferring the torque between the first group and the second group.

In this disclosure, "electronic control", as in "electronically controlled by an electronic motor control module", comprises to pass an electric current through an electromagnet to produce a magnetic field, wherein the magnetic field is to transfer the torque between the first group and the second group. As disclosed herein, transfer of the torque between the first group and the second group produces a fin torque on the first group and an engine torque on the second group, wherein the fin torques is to cause the fin to translate or rotate through and transfer momentum to the surrounding thrust fluid. The fin torque on the first group is to cause the fin to translate or rotate or rotate through and transfer momentum to the surrounding thrust fluid along a fin torque angle of rotation. The fin torque and the engine torque may have opposing vectors. The engine torque may comprise an engine torque angle of rotation.

In embodiments in which an orientation of the second group can be changed, such as by a gimbal or by electronic control, the engine torque angle of rotation may be a first engine torque angle of rotation and the engine torque may further comprise at least one of a second engine torque angle of rotation and a third engine torque angle of rotation. The first engine torque angle of rotation and at least one of the second engine torque angle of rotation and the third engine torque angle of rotation produce the fin torque, wherein the fin torque comprises a first fin torque angle of rotation and at least one of a second fin torque angle of rotation and a third fin torque angle of rotation, and wherein fin torque is to cause the fin to translate or rotate through and transfer momentum to the surrounding thrust fluid along the first fin torque angle of rotation and at least one of the second fin torque angle of rotation and the third fin torque angle of rotation. The first fin torque angle of rotation and at least one of a second fin torque angle of rotation and a third fin torque angle of rotation may produce a spiral path of the fin through the surrounding thrust fluid. In this embodiment, the fin may be a flagellum.

The fin may span between the one or more TREs and the electronic motor control module may be to drive a first TRE to thereby drive a first portion of the fin and the electronic motor control module may be to further drive a second TRE to thereby drive a second portion of the fin. The electronic motor control module may be to drive the second TRE to drive the second portion of the fin to precede or follow the first portion of the fin.

In embodiments, The robotic fish may comprise a third TRE and a fourth TRE and the electronic motor control module may be to drive the first TRE, the second TRE, the third TRE, and the fourth TRE to generate a plurality of waves in the fin, wherein the plurality of waves are to interfere and form a drive wave, wherein the drive wave is to cause the fin to translate or rotate through and transfer momentum to the surrounding thrust fluid along a drive wave thrust vector, wherein the drive wave thrust vector is to at least one of propel the robotic fish through the surrounding thrust fluid or to rotate the robotic fish in the surrounding thrust fluid.

In embodiments, a first of the one or more TRE may cause a wave to propagate through the fin, wherein the wave is to cause the fin to translate or rotate through and transfer momentum to the surrounding thrust fluid. The wave may be a first wave and a second TRE may cause a second wave to propagate through the fin. The first wave and the second wave may interfere with one another in the fin and form a drive wave.

As disclosed herein, a first TRE and a second TRE may be secured to an edge of the fin. Transfer of the torque between the first group and the second group may produce the fin torque on the first group and the engine torque on the second group, wherein the fin torque is one of perpendicular to an edge of the fin or tangent to the edge of the fin.

In embodiments, the first TRE may be secured to the edge of the fin along a center line of the first TRE and the electronic motor control module may transfer the torque between the first group and the second group by rotating the second group relative to the first group around an axis of rotation and wherein the center line of the first TRE is along the axis of rotation.

In embodiments, the fin torque is a first fin torque, wherein the first fin torque is to be produced by a first TRE of the one or more TREs, wherein a second of the one or more TREs is to produce a second fin torque, wherein the first fin torque is to cause the first wave to propagate through the fin and wherein the second fin torque is to cause the second wave to propagate through the fin. The first wave and the second wave may interfere with one another in the fin to form a drive wave, and wherein the electronic motor control module is to thereby generate the drive wave and cause the fin to translate or rotate through and transfer momentum to the surrounding thrust fluid and to thereby impart a thrust vector on the robotic fish. The electronic motor control module may control the first TRE and the second TRE to cause the thrust vector to at least one of propel the robotic fish through the surrounding thrust fluid or to rotate the robotic fish in the surrounding thrust fluid.

In embodiments, a plurality of TREs form a matrix or array in the fin. At least two or more of the plurality of TREs in the matrix or array in the fin may be driven by the electronic motor control module in at least one of a different phase, a different frequency, or a different power level. At least two or more of the plurality of TRE in the matrix or array in the fin may be driven by the electronic motor control module in at least one of the different phase, the different frequency, or the different power level to at least one of provide a steering force or a driving force on the robotic fish.

In embodiments, the fin may comprise one or more tendons. The one or more tendons may comprise a spring force, wherein the spring force is to return the fin to a lowest energy state. The one or more tendons may be arranged in the fin at least one of a fan, helical, radial, or straight pattern.

In embodiments, the fin may comprise at least one of a disk, an elongate disk, a flagellum, or a crescent. When the fin comprises a flagellum, the flagellum may comprise a tapered tube, rod, or cone (hereinafter, "cone"). The cone may comprise one or more flattened surfaces. The flattened surfaces may be found on one or more sides of the cone. The flattened surfaces may spiral around the cone. The fin may comprise a shape of fin of a fish or of a marine mammal, and or the fin may be formed in a predominantly flat shape, such as a sheet, wherein the sheet has two relatively long dimensions and one relatively short dimension. The two relatively long dimensions of the sheet may have a perimeter which is round, rectangular, triangular, square, or another geometric shape.

The electric motor may have a driveshaft or may have no driveshaft. When the electric motor has a driveshaft, the driveshaft may align the inner set of magnets and the outer set of magnets around a rolling bearing, such as a rolling bearing between the driveshaft and at least one of the inner set of magnets and the outer set of magnets. When the electric motor has no driveshaft, a bearing surface may be between the inner set of magnets and the inertial mass, on one side, and the outer set of magnets, on the other side. The bearing surface may be a closed ball-and-socket joint, "closed" in that the ball is not connected to a rod and the socket entirely surrounds the ball. The closed ball-and-socket joint may be lubricated with a lubricant. The lubricant may be dry, e.g. graphite, or may be liquid, e.g. oil. When the electric motor has no driveshaft, a matrix of bearings may occupy a space between the inner set of magnets and the inertial mass, on one side, and the outer set of magnets, on the other side. The matrix of bearings may comprise ball bearings. The ball bearings may be separated from one another by a bearing cage. A lubricant may lubricate the ball bearings.

When the electric motor has no driveshaft, the inner set of magnets and inertial mass may be magnetically suspended within a cavity between the outer set of magnets and the inner set of magnets, such as on a magnetic bearing. The magnetic bearing may comprise electromagnets and or permanent magnets in one or both of the inner set of magnets and the outer set of magnets. The permanent magnets may suspend a static load comprising the inner set of magnets and inertial mass while the electromagnets and the electronic motor control module may apply electronic control to correct deviations of the inner set of magnets and inertial mass from a desired position.

An electrical charge storage system may be present in one or more of the inertial mass and or a body of the robotic fish. The electrical charge storage system may comprise at least one of a capacitor, a battery, and or a fuel cell. The battery chemistry may comprise at least one of lead, lead-acid paste, nickel metal hydride, lithium polymer, iron, or the like.

Power may be transferred to the electrical charge storage system through a slip ring, through an induction charging system, through a wire, and the like.

At least one of the inner set of magnets and the outer set of magnets may be arranged in a geometry such as a icosohedron or another geometry which distributes magnets of at least one of the inner set of magnets and the outer set of magnets equally around a surface of a sphere.

DETAILED DESCRIPTION

It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section.

The figures and text therein illustrate and discuss examples of a craft that interacts with thrust fluid through use of a torque reaction engine (TRE) secured to a fin.

As discussed herein, "thrust fluid" may include a gas, a liquid, a plasma or other media comprising mass, wherein the media comprising mass may be accelerated by a moving fin, propeller, tubular curtain, cone, rod, or the like ("fin"), and wherein the fin may be moved by a motor or wherein the thrust fluid is of a moving stream of thrust fluid and the moving stream of thrust fluid moves the fin. The TRE and robotic fish discussed herein may be operated "in reverse", wherein a moving stream of thrust fluid moves the fin, thereby a TRE, and wherein the TRE thereby generates power.

As used herein, "releasable," "connect," "connected," "connectable," "disconnect," "disconnected," and "disconnectable" refers to two or more structures which may be connected or disconnected, generally without the use of tools or chemical or physical bonding (examples of tools including screwdrivers, pliers, drills, saws, welding machines, torches, irons, and other heat sources) and generally in a repeatable manner. As used herein, "attach," "attached," or "attachable" refers to two or more structures or components which are attached through the use of tools or chemical or physical bonding. As used herein, "secure," "secured," or "securable" refers to two or more structures or components which are either connected or attached.

U.S. patent application Ser. No. 15/101,901 discloses a torque reaction engine (TRE), which may be used in a watercraft to achieve a fish-like motion. The resulting craft swims like a fish or marine mammal, without the myriad parts that plague other mechanical craft that attempt to swim like a fish or marine mammal.

As used herein, an inertial mass of the second group may comprise, for example, lead, iron, steel, a pack of batteries, a lead-acid paste battery, a lead-acid paste battery or another battery chemistry in a toroidal shape, an electromagnet, a heavy or dense object, and the like.

The second group may be within the interior of an isolation chamber or pressure vessel. The pressure vessel may contain the TRE and form its exterior surface that is secured to the remainder of a hull or fin of the robotic fish. The pressure vessel may seal the electronic components away from the surrounding thrust fluid, such as surrounding water.

Unlike conventional craft that accelerate thrust fluid through use of a propeller connected to a motor via a driveshaft, there may be no penetration in the pressure vessel of a TRE for a moving component, such as a driveshaft. In conventional inboard watercraft, the driveshaft typically penetrates the hull, requiring a seal around the spinning driveshaft. The driveshaft seal presents a problem for conventional craft. It can leak and degrade. It is a source of friction. It costs money to fabricate and maintain. In craft that go deep in water (e.g., more than several hundred feet), to prevent high pressure water from leaking through the driveshaft seal, a complex labyrinth seal may be used or an electric motor connected to the propeller may be flooded with oil. The labyrinth seal or oil may prevent water from contaminating the motor; however, labyrinth seals still have depth limitations and are a source of drive train friction and flooding a motor with oil significantly decreases its operating efficiency. Penetrations in the hull to accommodate a moving component such as a driveshaft are a real and severe problem that limits depth and operating range.

In contrast in a TRE, there does not have to be a penetration in the pressure vessel or hull for a moving component, because the second group is within the interior of the pressure vessel and because the motor of the TRE transfers momentum between the first group, comprising the fin, and the second group, comprising the inertial mass.

The pressure vessel may be spherical, tubular, square, rectangular, or another shape, though spherical shapes are generally more able to resist and distribute compression forces. The pressure vessel may be toroidal in shape, such that a passage passes through a center of pressure vessel. However, the passage through the center of the central shaft in a toroidal pressure vessel does not penetrate the toroidal pressure vessel. Such a passage may be used to secure a harness to the craft, to exhaust heat from the TRE, as a location for environmental sensors, or as a conduit for transmitting data, signals, or power into an interior of the TRE, or as a location for tail.

During a first phase of operation of a TRE, the motor may apply power to transfer momentum between the first group and the second group. During a second phase of operation of the TRE, the motor may decelerate or change the momentum transfer between the first group and the second group, such as through application of a brake. The motor may be an electric motor or an internal combustion motor. The brake may generate power, such as when the motor is an electric motor and the brake is an electronic or magnetic brake or such as when the motor is an internal combustion engine and the brake comprises a system to compress gas or accelerate a fly wheel.

A flexible material secured to or part of the fin may flex in response to movement of the fin. Such flex may compress and/or expand the flexible material, such as between at least first and second shapes. The flexible material may store energy as it compresses or expands. The flexible material may release stored energy and return to an original or resting shape, as may occur when the pressure vessel stops moving; alternatively, the flexible material may be pliable and/or may not store appreciable energy. The flexible material may have one or more states of strain deformation. The flexible material may transition between at least first and second shapes in response to or as allowed by movement of at least a first and a second TRE and/or in response to or as allowed by release or storage of energy in the flexible material, which may result in movement of strain deformations along the flexible material.

The flexible material may comprise rubber, polyurethane, or the like. Fibers or tendons may be within the flexible material. The tendons within the flexible material may follow one or more patterns, such as a round pattern, helical pattern, a chevron pattern, a triangular pattern, a straight pattern, or the like. The tendons may span from the first group into the flexible material. The tendons may hold the first group to the TRE or pressure vessel. The tendons may comprise fibers, rods, or the like. Rods may comprise joints, such as at the ends of the rods, where the rods contact the TRE, the pressure vessel, and the flexible material.

The flexible material may have a first shape, wherein the first shape may be a resting shape, and/or wherein the first shape may store or comprise a different amount of energy relative to a second shape, wherein the energy may be potential energy. The flexible material may have at least a second shape. The second shape may be a bent version of the first shape, e.g. compressed, stretched, twisted, expanded, etc. Transition between the first and second shapes may be caused by and/or may produce a wave. The wave may traverse the flexible material. The wave may store or release energy in a local portion of the flexible material. The wave may be produced by a movement of at least one TRE.

Flexure of the tail caused by a TRE and oscillation of the pressure vessel may cause a wave to propagate along the tail. Propagation of the wave along the tail may be performed to accelerate thrust fluid, produce thrust and steer the craft.

Robotic fish disclosed herein may comprise one or motor controllers, to control oscillation of TRE. Robotic fish may comprise one or more power controllers, to control a battery pack in the inertial mass of the TRE and the supply of power to TRE.

A robotic fish may comprise acoustic and chemical sensors and emitters, as well as radio frequency sensors and emitters.

Buoyancy for robotic fish may be provided at least in part by flexible material and/or by one or more displacement volume(s) within the first group, the second group, or the fin. Displacement volume(s) may comprise, for example, a vacuum, a gas or a liquid that is lighter or heavier than a surrounding thrust fluid. A volume of such vacuum, gas, or liquid may be increased or decreased within the displacement volume, such as by a pump, a piston, a valve or the like. The displacement volume may, for example, occupy one or more sectors of the TRE. The vacuum, gas, or liquid may be pumped or allowed to pass between within sectors to relocate a center of displacement of the robotic fish.

The center of mass of the robotic fish may be changed by changing the location of the TRE. Buoyancy may be adjustable, to increase or decrease buoyancy.

Electrical power may be transferred to a battery pack or the like within inertial mass through induction, through brushes (not illustrated), through a slip ring (not illustrated), or the like.

FIG. 1 illustrates a side elevation of robotic fish 101 comprising torque reaction engine (TRE) 105 and fin 110 in the form of a flagellum, in accordance with an embodiment.

Figure 2:
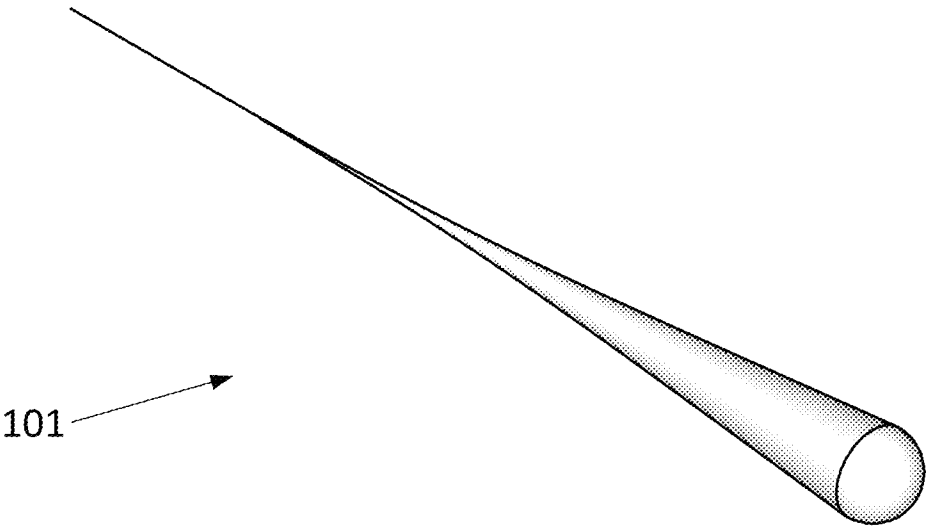
FIG. 2 illustrates an isomorphic parallel projection view of the robotic fish of FIG. 1, in accordance with an embodiment.

FIG. 2 illustrates an isomorphic parallel projection view of robotic fish 101 of FIG. 1, in accordance with an embodiment.

Figure 3A:
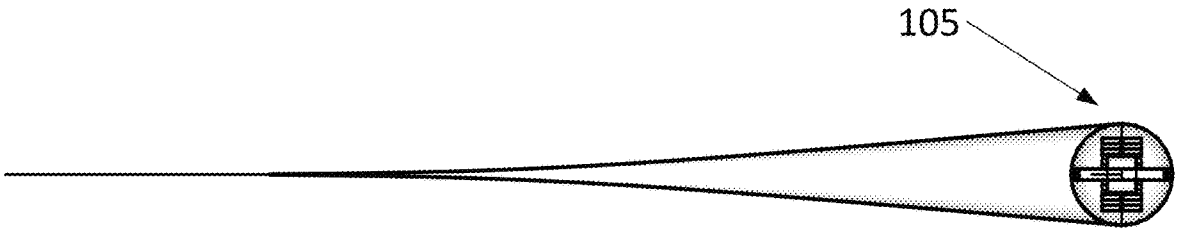
FIG. 3A illustrates a side elevation of the robotic fish of FIG. 1 with a section view, in accordance with an embodiment.

FIG. 3A illustrates a side elevation of robotic fish 101 of FIG. 1 with a section view, in accordance with an embodiment.

Figure 3B:
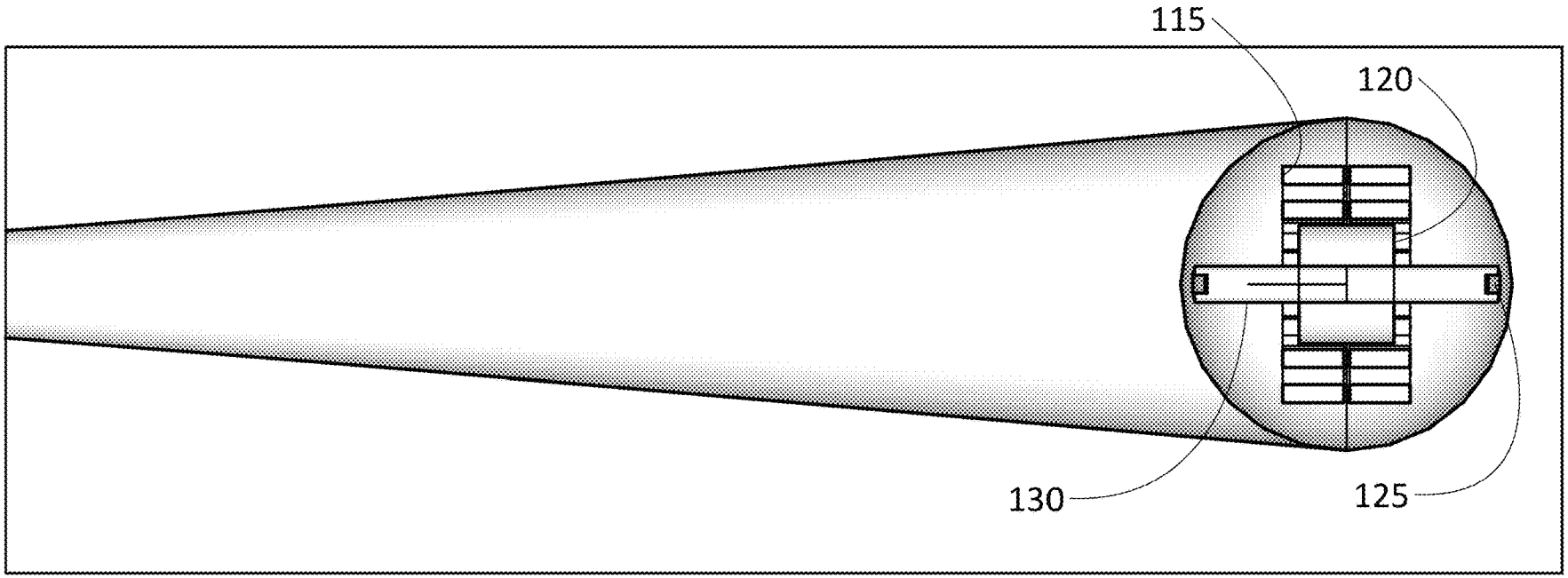
FIG. 3B illustrates a close side elevation of the robotic fish of FIG. 1 with a section view, in accordance with an embodiment.

FIG. 3B illustrates a close side elevation of the robotic fish of FIG. 1 with a section view, in accordance with an embodiment. Illustrated is inertial mass 115, which may comprise a battery pack. Illustrated is motor 120, which may comprise a first set of magnets secured to driveshaft 130, forming a first group, a second set of magnets secured to inertial mass 115, forming a second group, and a bearing, wherein the bearing allows the first group to rotate relative to the second group.

Figure 4A:
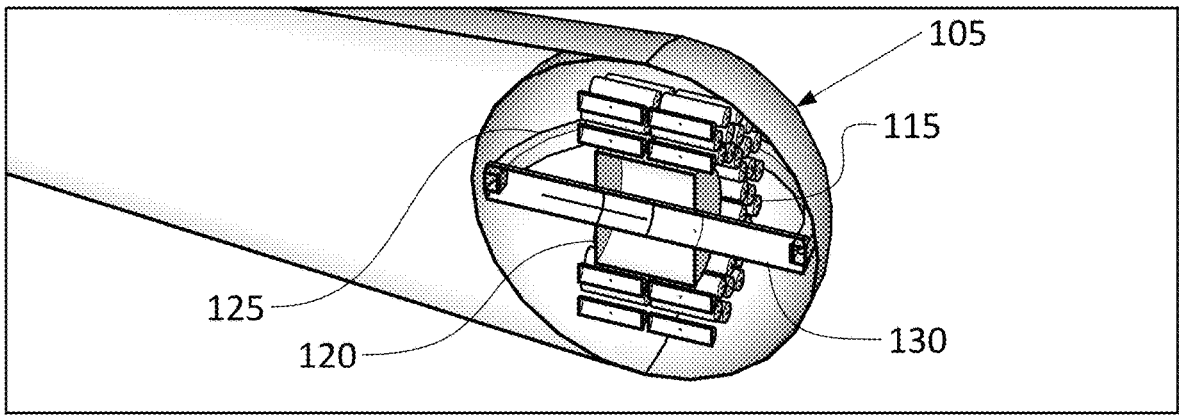
FIG. 4A illustrates a first oblique section view of the robotic fish of FIG. 1, with inertial mass in a first position on an annular ring, in accordance with an embodiment.

FIG. 4A illustrates a first oblique section view of robotic fish 101 of FIG. 1, with inertial mass 115 in a first position on annular ring 125, in accordance with an embodiment. Annular ring 125 may also be referred to herein as a gimbal. Multiple gimbals may be suspended within one another.

Figure 4B:
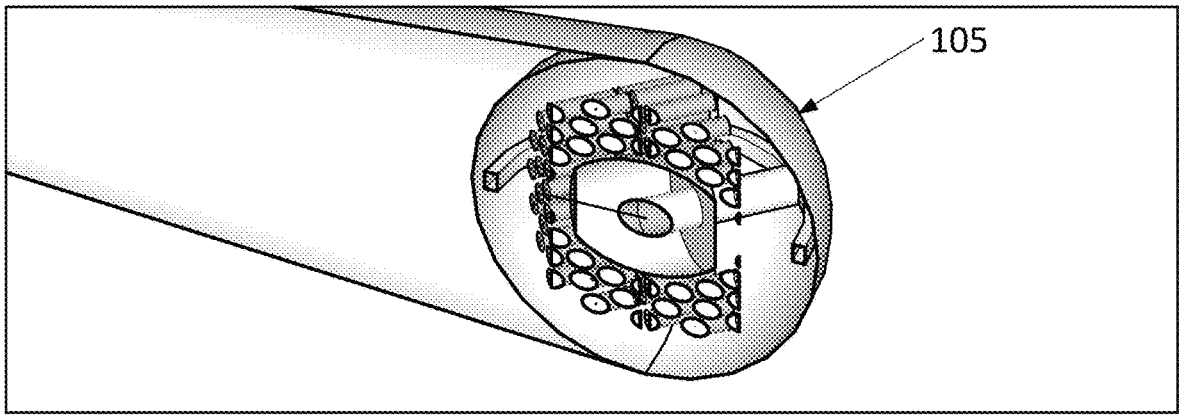
FIG. 4B illustrates the first oblique section view of FIG. 4A, with inertial mass in a second position on the annular ring, in accordance with an embodiment.

FIG. 4B illustrates the first oblique section view of FIG. 4A, with inertial mass 115 in a second position on annular ring 125, in accordance with an embodiment.

Figure 4C:
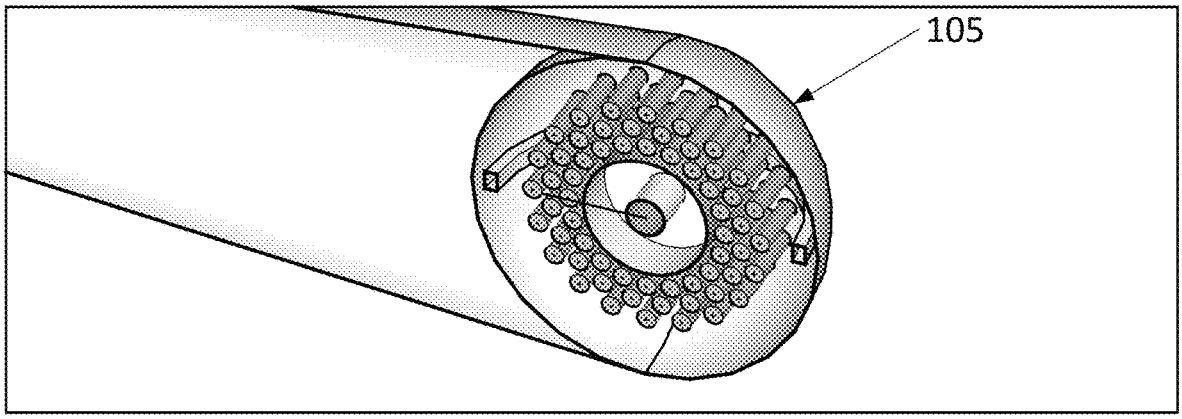
FIG. 4C illustrates the first oblique section view of FIG. 4A, with inertial mass in a third position on the annular ring, in accordance with an embodiment.

FIG. 4C illustrates the first oblique section view of FIG. 4A, with inertial mass 115 in a third position on annular ring 125, in accordance with an embodiment.

Figure 5A:
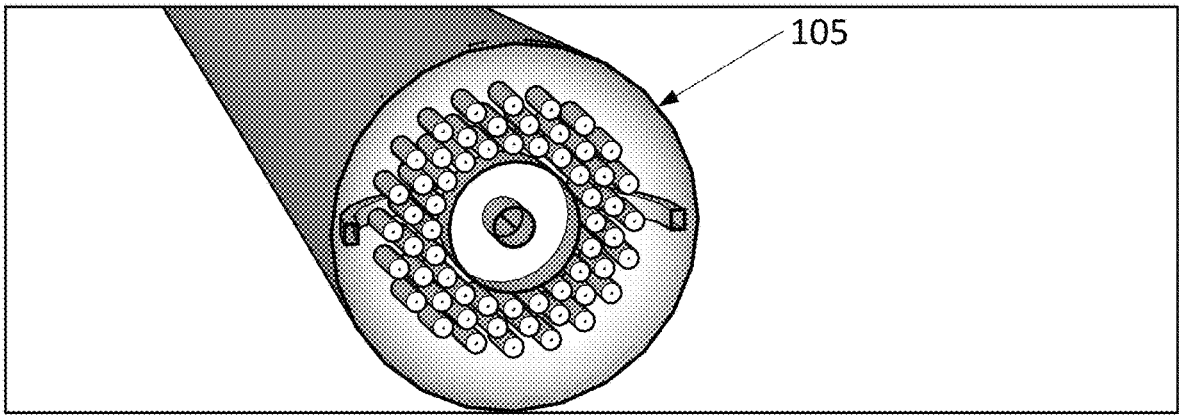
FIG. 5A illustrates a second oblique section view of the robotic fish of FIG. 1, with inertial mass in the first position on the annular ring, in accordance with an embodiment.

FIG. 5A illustrates a second oblique section view of the robotic fish of FIG. 1, with inertial mass 115 in the first position on annular ring 125, in accordance with an embodiment.

Figure 5B:
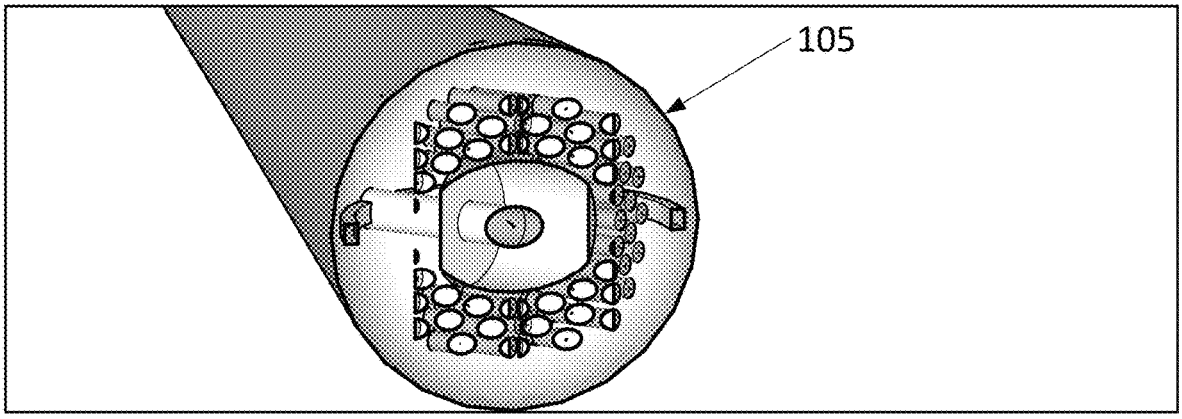
FIG. 5B illustrates the second oblique section view of FIG. 5A, with inertial mass in the second position on the annular ring, in accordance with an embodiment.

FIG. 5B illustrates the second oblique section view of FIG. 5A, with inertial mass 115 in the second position on annular ring 125, in accordance with an embodiment.

Figure 5C:
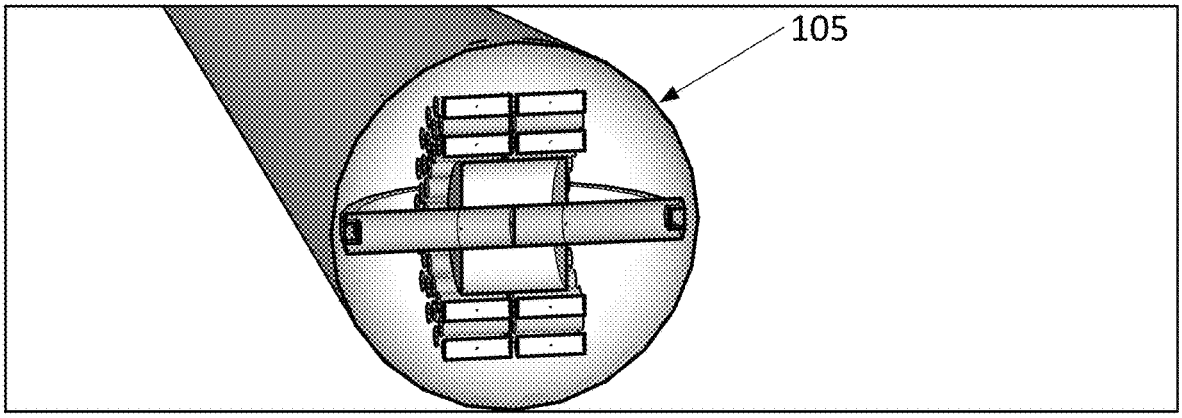
FIG. 5C illustrates the second oblique section view of FIG. 5A, with inertial mass in the third position on the annular ring, in accordance with an embodiment.

FIG. 5C illustrates the second oblique section view of FIG. 5A, with inertial mass 115 in the third position on annular ring 125, in accordance with an embodiment.

An actuator such as a stepper motor may change the position of inertial mass 115 on annular ring or gimbal. Changing the position of inertial mass 115 on annular ring 125 results in a change in orientation of fin torque on fin 110.

Figure 6A:
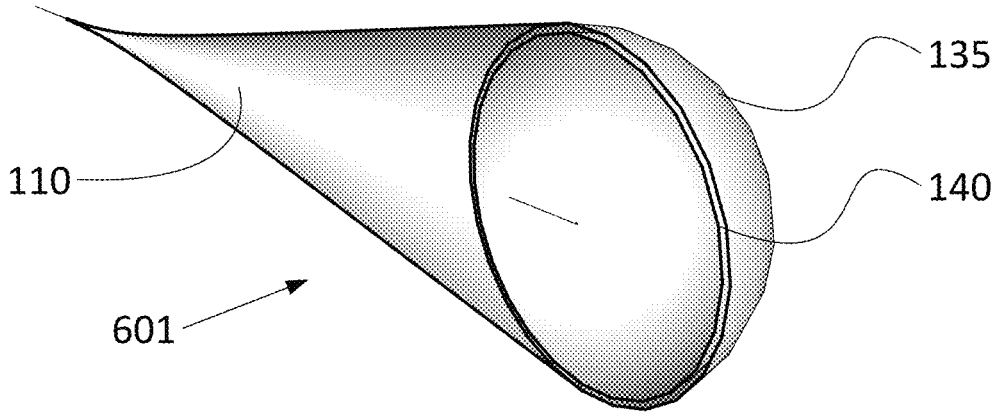
FIG. 6A illustrates an oblique section view of a robotic fish comprising a floating inertial mass, in accordance with an embodiment.

FIG. 6A illustrates an oblique section view of robotic fish 601 comprising isolation chamber 135, floating inertial mass 140, and fin 110 in accordance with an embodiment. As discussed herein floating inertial mass 140 may be a component of the second group.

Figure 6B:
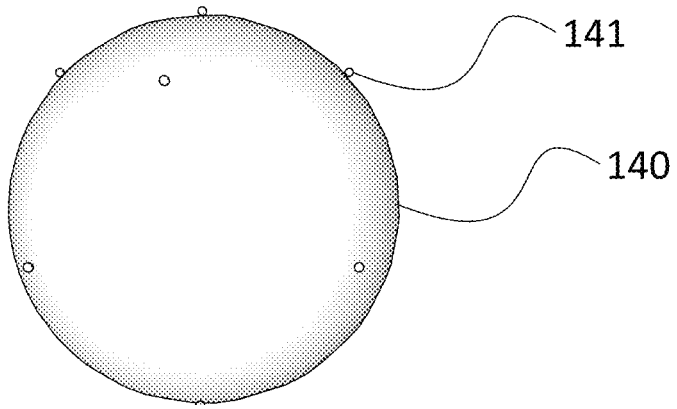
FIG. 6B illustrates the oblique view of FIG. 6A, without fin for the sake of clarity and with roller bearings, in accordance with an embodiment.

FIG. 6B illustrates the oblique view of floating inertial mass 140 of FIG. 6A, without flagellum for the sake of clarity and with roller bearings 141, in accordance with an embodiment.

Figure 6C:
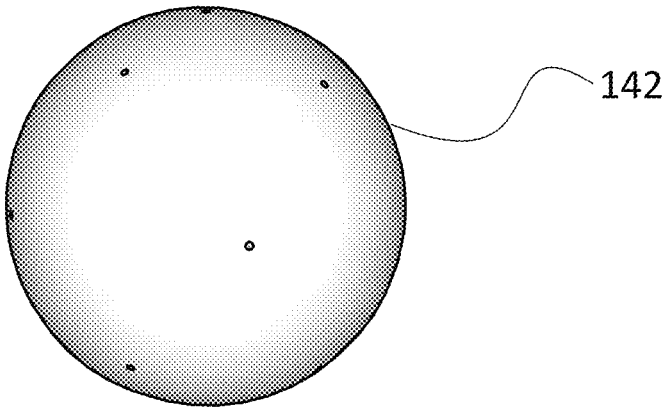
FIG. 6C illustrates a roller bearing cage for the roller bearings of FIG. 6B, in accordance with an embodiment.

FIG. 6C illustrates roller bearing cage 142 for the roller bearings 141 of FIG. 6B, in accordance with an embodiment.

Figure 7A:
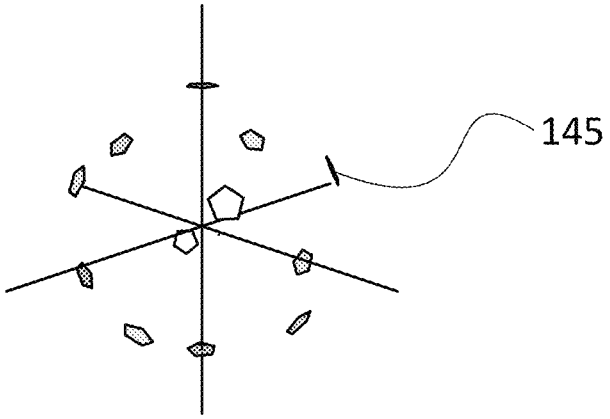
FIG. 7A illustrates a geometry of an outer set of magnets, in accordance with an embodiment.

FIG. 7A illustrates a geometry of an outer set of magnets 145, in accordance with an embodiment.

Figure 7B:
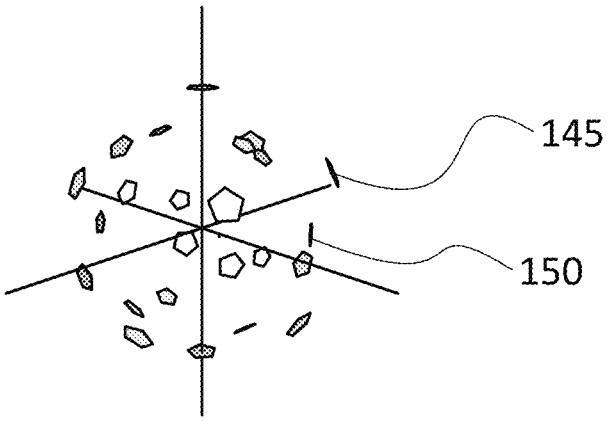
FIG. 7B illustrates a geometry of the outer set of magnets and an inner set of magnets, in accordance with an embodiment.

FIG. 7B illustrates a geometry of outer set of magnets 145 and inner set of magnets 150, in accordance with an embodiment. Each pentagon represents a terminus of a magnet. In the example illustrated in FIG. 7A and FIG. 7B, twenty magnets are equally space around a sphere, forming an icosahedron. Some or all of the outer set of magnets may be electromagnets or permanent magnets. Some or all of the inner set of magnets may be electromagnets or permanent magnets. In embodiments, the outer set of magnets may be permanent and the inner set of magnets may be electromagnets. In embodiments in which the motor is an induction motor, the outer set of magnets may be electromagnets and the inner set of magnets may be electromagnets.

Figure 7C:
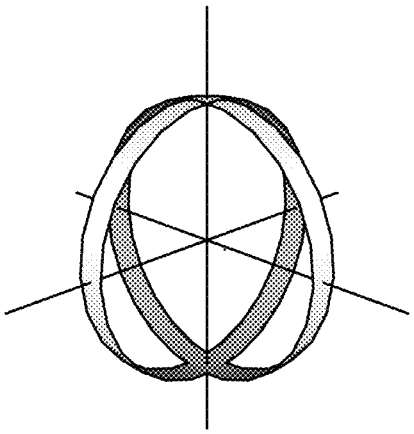
FIG. 7C illustrates a geometry of a set of magnets, in accordance with an embodiment.

Another number of magnets and geometry may be used. For example, two perpendicular bands of magnets, each band substantially similar to a band of magnets as may be found in a stator or rotor of a conventional electronic motor, may intersect one another at two areas; corresponding bands may be arranged within or around such bands. Such perpendicular bands of magnets are illustrated in FIG. 7C. The use of an a set of magnets with equal spacing around the sphere, such as an icosahedron, may allow transfer of momentum between the first group and the second group along a wide range of angles at any time. When referring to the first group, such angles may be referred to herein as engine torque angle(s) of rotation; when referring to the second group, such angles may be referred to herein as fin torque angle(s) of rotation; the engine torque angle(s) of rotation may be opposing to the fin torque angle(s) of rotation. With a floating inertial mass and magnets equally and uniformly spaced, the TRE may be capable of transferring torque between the first group and the second group and thereby generating three engine torque angles of rotation and three opposing fin torque angles of rotation, corresponding to three axis. The use of two perpendicular bands of magnets may allow transfer of momentum between the first group and the second group along the two perpendicular angles; in which case, the TRE may be capable of transferring torque between the first group and the second group and thereby generating two engine torque angles of rotation and two fin torque angles of rotation, opposing the two engine torque angles of rotation.

In the examples illustrated herein, the floating inertial mass may allow transfer of torque between the first group and the second group along an zig-zag pattern defined by at least a first and a second engine torque angle of rotation, such as a sinusoidal pattern or a saw-tooth pattern, using only the actuator of the electronic motor control module and electromagnets of the TRE. Such a pattern may, for example, produce robotic fish which swim along a spiral path, similar to a biological flagellum or sperm. Control of a center of such pattern may allow a robotic fish to be steered toward the center of such pattern.

When the TRE has a driveshaft, as in FIG. 4A to FIG. 5C, the inertial mass may allow transfer of torque between the first group and the second group along a pattern defined by at least the first engine torque angle of rotation, such as a back-and-forth pattern, as when the driveshaft is oriented tangentially to the long axis of the fin as in FIG. 5C, or a circular pattern, as when the driveshaft is oriented parallel to the long axis of the fin as in FIG. 5A. When the inertial mass is oriented as in FIG. 5B, between tangential and parallel, the TRE may achieve a sinusoidal pattern or a saw-tooth pattern, using the actuator of the electronic qwamotor control module and electromagnets of the TRE. Such a pattern may, for example, produce robotic fish which swim along a spiral path, similar to a biological flagellum or sperm. Control of a center of such pattern, e.g. using the gimbal, may allow a robotic fish to be steered toward the center of such pattern.

Figure 8:
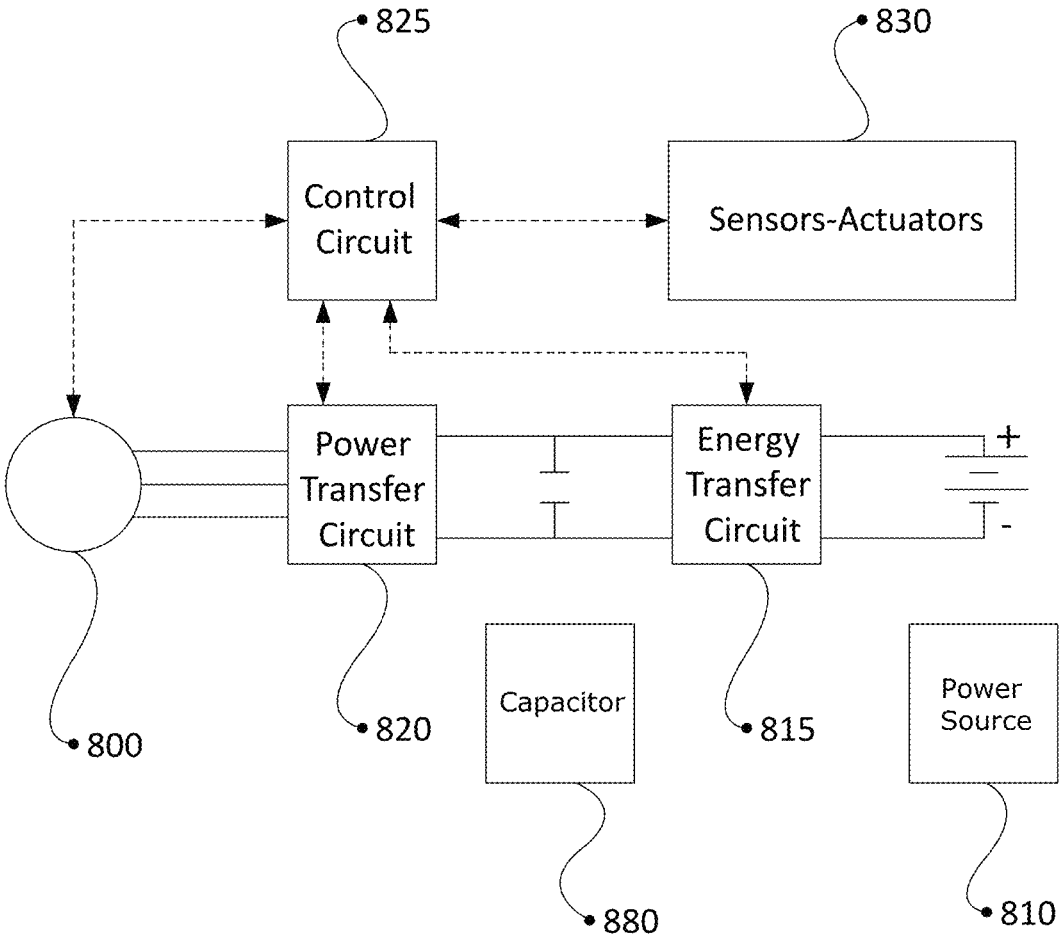
FIG. 8 illustrates an example of a control system for a robotic fish, in accordance with an embodiment.

FIG. 8 illustrates an example of a control system for a robotic fish, in accordance with an embodiment. The control system may also be referred to herein as an electronic motor control module.

When a TRE is operated, such as by an electronic motor control module, to transfer torque between the first group and the second group and to produce a fin torque on the first group and an engine torque on the second group, wherein the fin torque is to cause the fin to translate or rotate through and transfer momentum to the surrounding thrust fluid, the fin torque may cause the first group to spin, first in a first direction along an angle of rotation, wherein the angle of rotation is a fin torque angle of rotation, then a second direction along the fin torque angle of rotation, or may spin in a first direction along the fin torque angle of rotation, followed by a period of spin-down, so that the first group may be spun again in the first direction along the angle of rotation. As the fin, such as a flagellum, may be made of a flexible material, spinning of the flagellum caused by the fin torque may cause torsional instability in the fin, which may result in transmission of a drive wave down the fin. The drive wave may couple with a surrounding thrust fluid and impart a thrust vector on the robotic fish. Orientation of the drive wave may be controlled to steer or direct the robotic fish toward an objective. An orientation of the drive wave may be controlled by controlling an angle of torque transfer between the first group and the second group and, thereby, controlling the engine torque angle of rotation, the fin torque angle of rotation, an orientation of the drive wave, and thereby, the orientation of the thrust vector on the robotic fish. Controlling the angle of torque transfer between the first group and the second group may be accomplished by changing an orientation of a driveshaft of the TRE, such as by moving the driveshaft with a gimbal actuator within the isolation chamber, as illustrated in FIG. 4A to FIG. 5C. When the TRE does not comprise a driveshaft, wherein the second group floats within the first group, controlling the angle of torque transfer between the first group and the second group may be accomplished by changing which electromagnets in the first group and the second group are energized by the electronic motor control module.

A TRE comprising no driveshaft, in which the second group floats within the first group, and wherein the first group is closed, has never been conceived before and is a radical departure in motor design. The nearest analog is a magnetic levitation system or a magnetically controlled ball-and-socket joint, though magnetic levitation systems are typically conceived for use in linear contexts in the air or in a vacuum and ball-and-socket joints are not closed, but have a rod attached to the ball. A TRE with no driveshaft, in a closed ball-and-socket joint secured to a fin, is completely new, innovative, and not suggested by prior art. A robotic fish with a fin in the form of a flagellum, driven by a TRE is also completely new, innovative, and not suggested by prior art, whether the TRE has a driveshaft or has no driveshaft.

Figure 9:
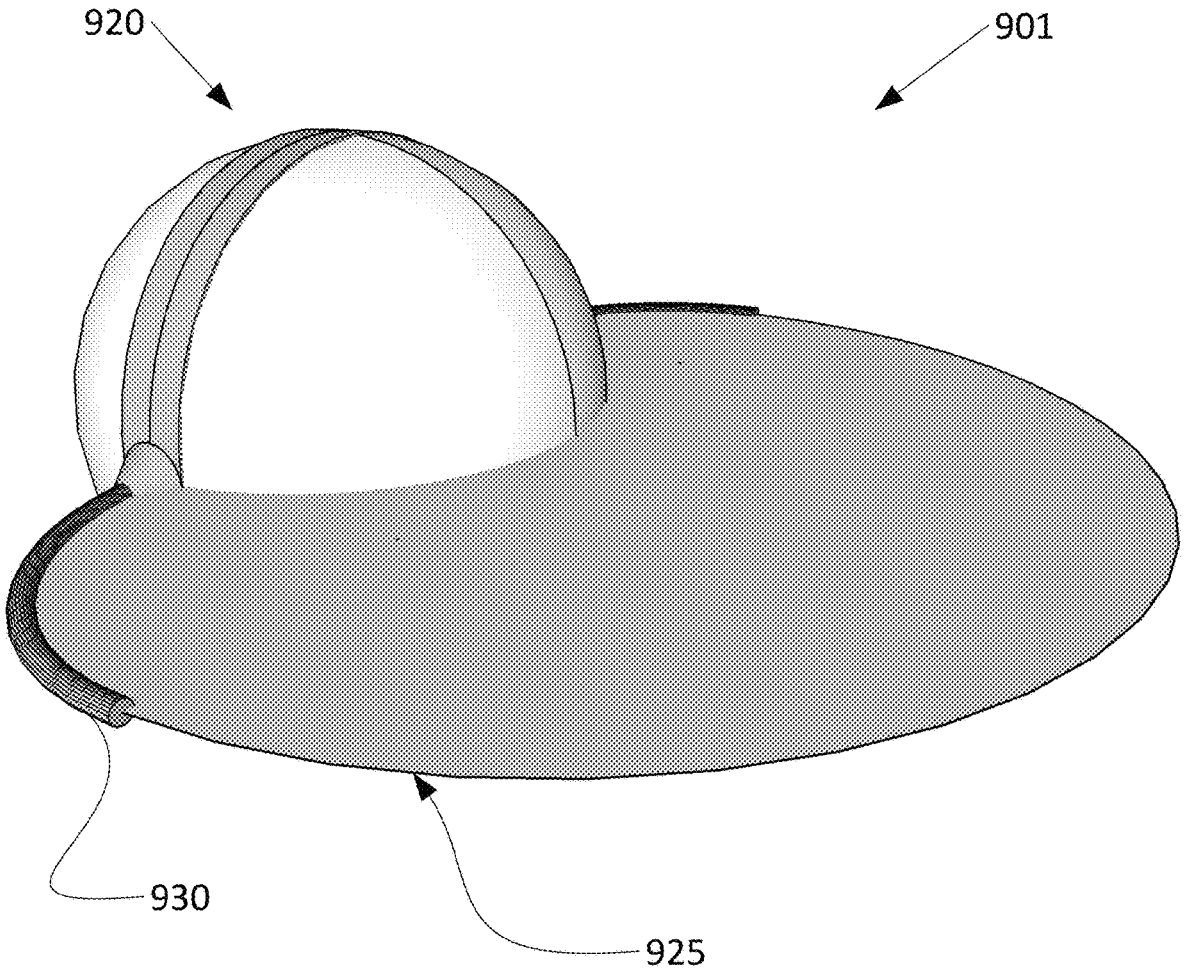
FIG. 9 illustrates an example of a robotic fish comprising one torque reaction engine (TRE), in accordance with an embodiment.

FIG. 9 illustrates an example of robotic fish 901 comprising one TRE 920, fin 925, and tendon 930, in accordance with an embodiment. TRE 920 may be as illustrated in one or more of FIG. 4A to FIG. 6C. Fin 925 may be a flexible material. Tendon 930 may be rigidly secured to TRE 920. TRE 920 may be capable of producing fin torque angles of rotation which are perpendicular to fin 925, which are tangent to fin 925, a combination thereof, or which comprise a third fin torque angle of rotation. In this manner, an electronic motor control module of robotic fish 901 may produce a drive wave in fin 925, a thrust vector on robotic fish 901, and may change an orientation of the drive wave and thrust vector, such as to propel and or steer robotic fish 901.

Figure 10:
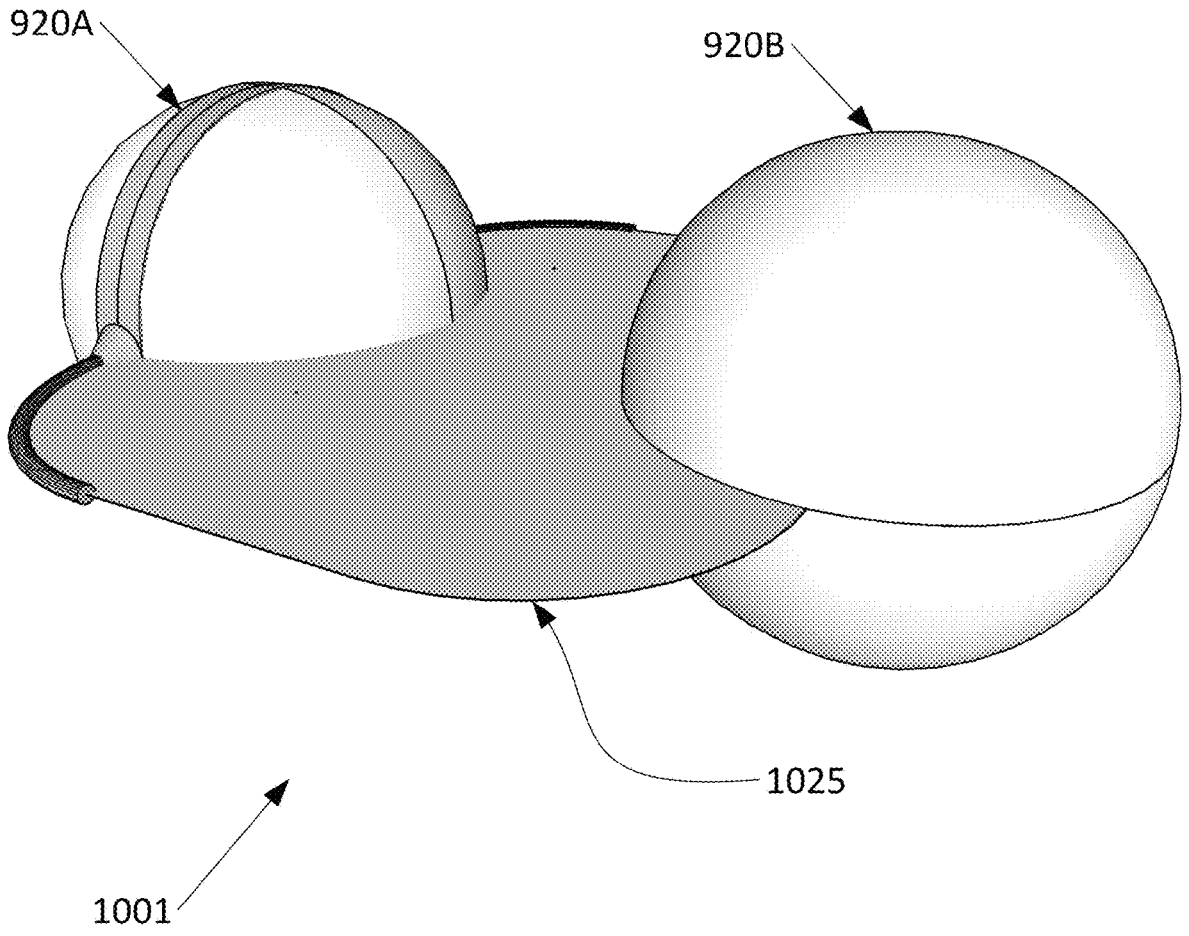
FIG. 10 illustrates an example of a robotic fish comprising two TREs, in accordance with an embodiment.

FIG. 10 illustrates an example of robotic fish 1001 comprising two TREs, TRE 920A and TRE 920B, and fin 1025, in accordance with an embodiment. As in FIG. 9, TRE 920A and TRE 920B may be capable of producing fin torque angles of rotation which are perpendicular to fin 1025, which are tangent to fin 1025, a combination thereof, or which comprise a third fin torque angle of rotation. An electronic motor control module of robotic fish 1001 may drive one of TRE 920A or TRE 920B to precede or follow the other TRE, such as by controlling a relative phase, frequency, or power of torque transfer between a first group and a second group within each TRE. A first wave produced by TRE 920A may interfere with a second wave produced by TRE 920B, to produce a third wave, e.g. a drive wave in fin 1025. In this manner, an electronic motor control module of TRE 920A and TRE 920B may produce a drive wave in fin 1025, a thrust vector on robotic fish 1001, and may change an orientation of the drive wave and thrust vector, such as to propel and or steer robotic fish 1001.

Figure 11:
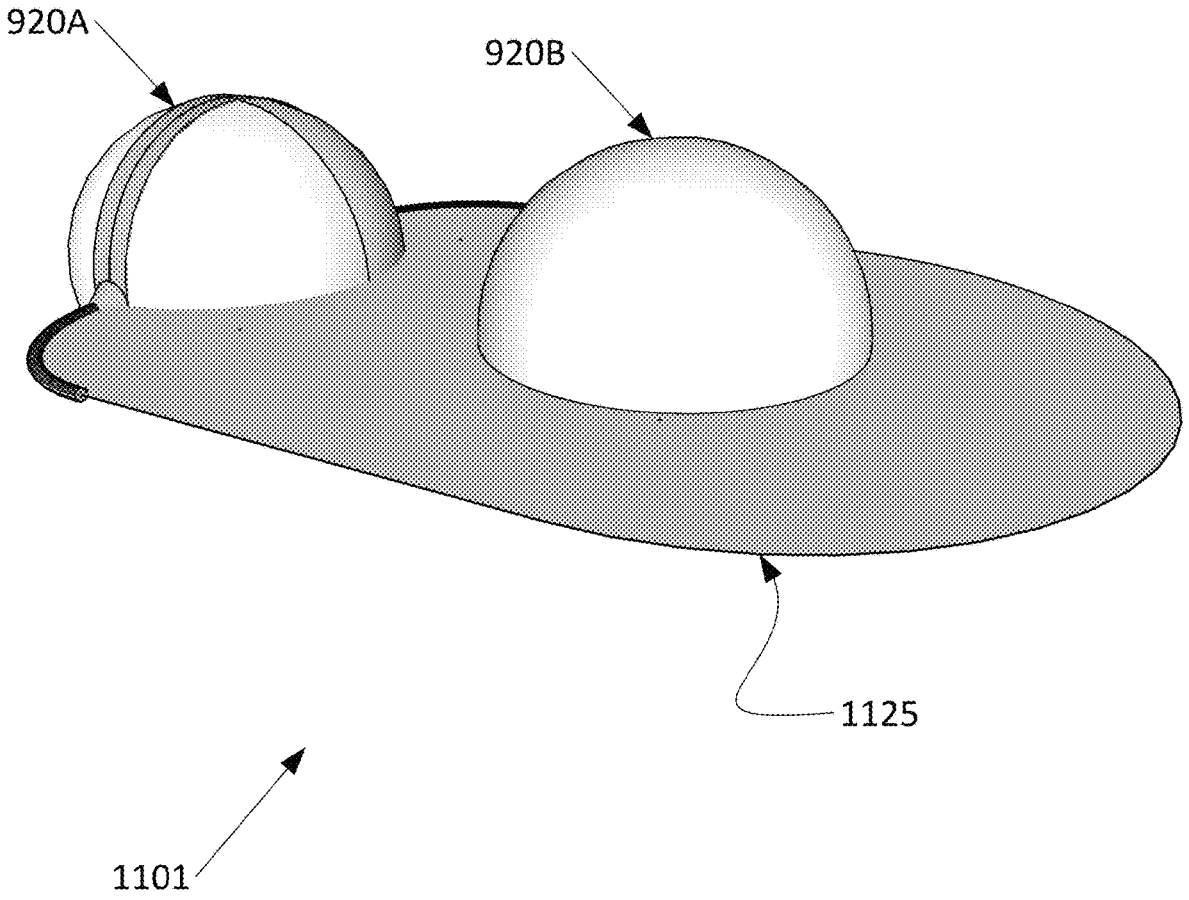
FIG. 11 illustrates an example of a robotic fish comprising two TREs, in accordance with an embodiment.

FIG. 11 illustrates an example of robotic fish 1101 comprising two TREs, TRE 920A and TRE 920B, and fin 1125, in accordance with an embodiment. As in FIG. 9 and FIG. 10, TRE 920A and TRE 920B may be capable of producing fin torque angles of rotation which are perpendicular to fin 1125, which are tangent to fin 1125, a combination thereof, or which comprise a third fin torque angle of rotation. An electronic motor control module of robotic fish 1101 may drive one of TRE 920A or TRE 920B to precede or follow the other TRE, such as by controlling a relative phase, frequency, or power of torque transfer between a first group and a second group within each TRE. A first wave produced by TRE 920A may interfere with a second wave produced by TRE 920B, to produce a third wave, e.g. a drive wave in fin 1125. In this manner, an electronic motor control module of TRE 920A and TRE 920B may produce a drive wave in fin 1125, a thrust vector on robotic fish 1101, and may change an orientation of the drive wave and thrust vector, such as to propel and or steer robotic fish 1101. Compared to robotic fish 1001, robotic fish 1101 may be capable of higher speed and or more efficient motion in a direction toward TRE 920A. A streamlined fairing may span around TRE 920A and TRE 920B, to smooth flow of thrust fluid around robotic fish 1101. One or more tendons may be embedded within or around fin 1125.

Figure 12:
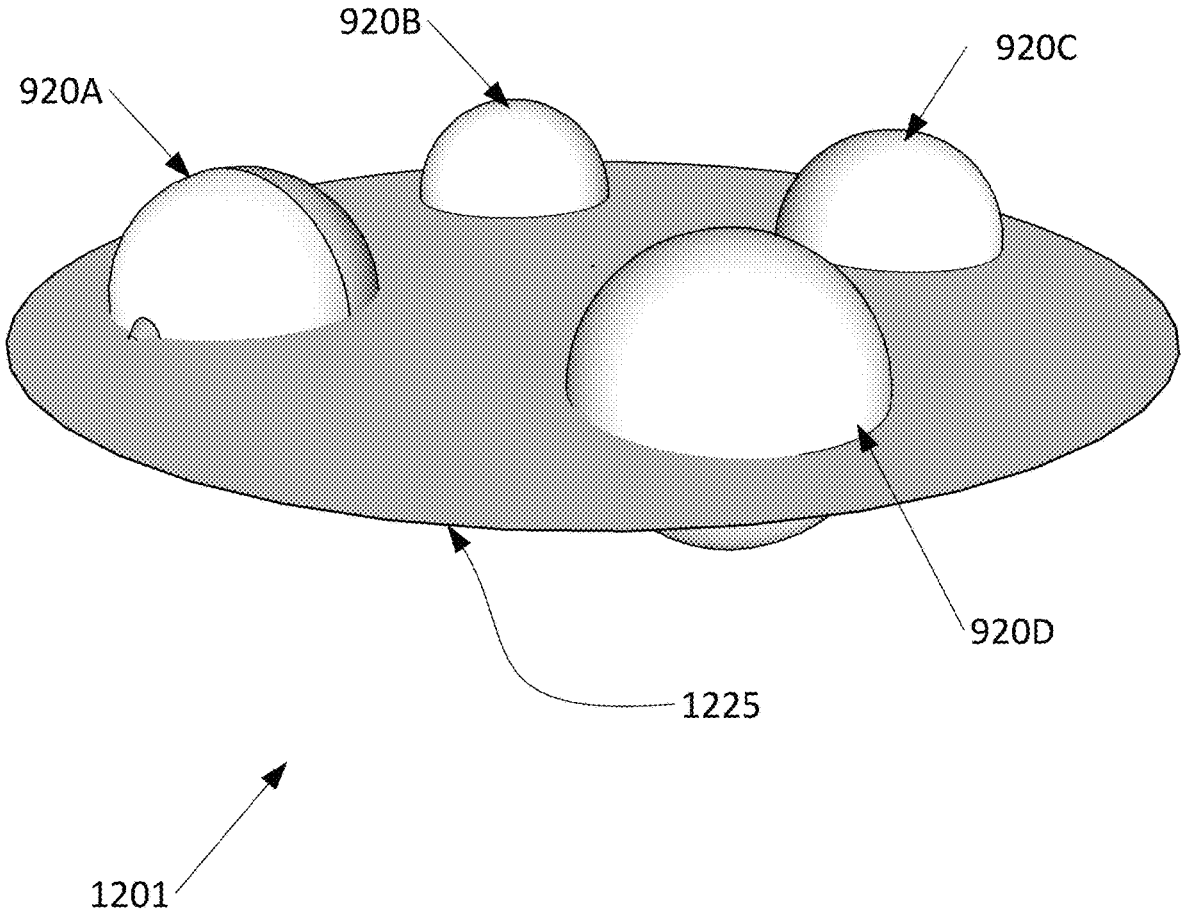
FIG. 12 illustrates an example of a robotic fish comprising four TREs, in accordance with an embodiment.

FIG. 12 illustrates an example of robotic fish 1201 comprising four TREs, TRE 920A, TRE 920B, TRE 920C, and TRE 920D, and fin 1225, in accordance with an embodiment. As in FIG. 9, FIG. 10, and FIG. 11, TRE 920A, TRE 920B, TRE 920C, and TRE 920D may be capable of producing fin torque angles of rotation which are perpendicular to fin 1225, which are tangent to fin 1225, a combination thereof, or which comprise a third fin torque angle of rotation. An electronic motor control module of robotic fish 1201 may drive one of TRE 920A, TRE 920B, TRE 920C, and TRE 920D, to precede or follow another TRE, such as by controlling a relative phase, frequency, or power of torque transfer between a first group and a second group within each TRE. A first wave produced by TRE 920A, a second wave produced by TRE 920B, a third wave produced by TRE 920C, and a fourth wave produced by TRE 920D may interfere to produce a fifth wave, e.g. a drive wave in fin 1225. In this manner, an electronic motor control module of robotic fish 1201 may produce a drive wave in fin 1225, a thrust vector on robotic fish 1201, and may change an orientation of the drive wave and thrust vector, such as to propel and or steer robotic fish 1201. Robotic fish 1201 may be highly maneuverable, capable of changing orientation of the drive wave and thrust vector, with or without changing a fin torque angle of rotation of one or more of TRE 920A, TRE 920B, TRE 920C, and TRE 920D. A streamlined fairing may span around TRE 920A, TRE 920B, TRE 920C, and TRE 920D, to smooth flow of thrust fluid around robotic fish 1201. One or more tendons may be embedded within or around fin 1225.

Figure 13:
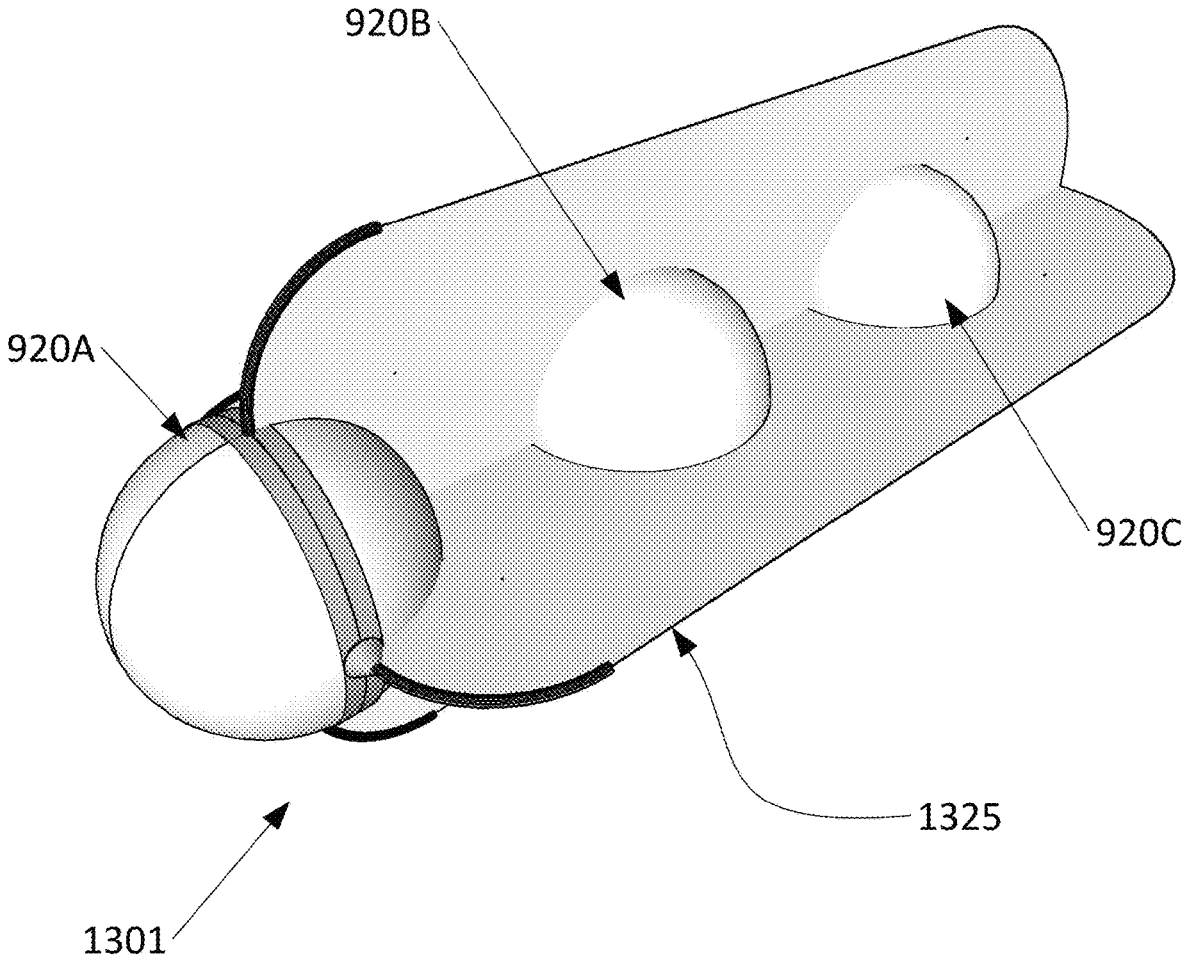
FIG. 13 illustrates an example of a robotic fish comprising three TREs, in accordance with an embodiment.

FIG. 13 illustrates an example of robotic fish 1301 comprising TRE 920A, TRE 920B, TRE 920C, and fin 1325, in accordance with an embodiment. As in FIG. 9, FIG. 10, FIG. 11, and FIG. 12, TRE 920A, TRE 920B, and TRE 920C may be capable of producing fin torque angles of rotation which are perpendicular to a perimeter of fin 1325, which are tangent to the perimeter of fin 1325, a combination thereof, or which comprise a third fin torque angle of rotation. An electronic motor control module of robotic fish 1301 may drive one of TRE 920A, TRE 920B, and TRE 920C to precede or follow another TRE, such as by controlling a relative phase, frequency, or power of torque transfer between a first group and a second group within each TRE. A first wave produced by TRE 920A, a second wave produced by TRE 920B, and a third wave produced by TRE 920C may interfere to produce a fourth wave, e.g. a drive wave in fin 1325. In this manner, an electronic motor control module of robotic fish 1301 may produce a drive wave in fin 1325, a thrust vector on robotic fish 1301, and may change an orientation of the drive wave and thrust vector, such as to propel and or steer robotic fish 1301. A streamlined fairing may span around TRE 920A, TRE 920B, and TRE 920C to smooth flow of thrust fluid around robotic fish 1301. One or more tendons may be embedded within or around fin 1325.

Figure 14:
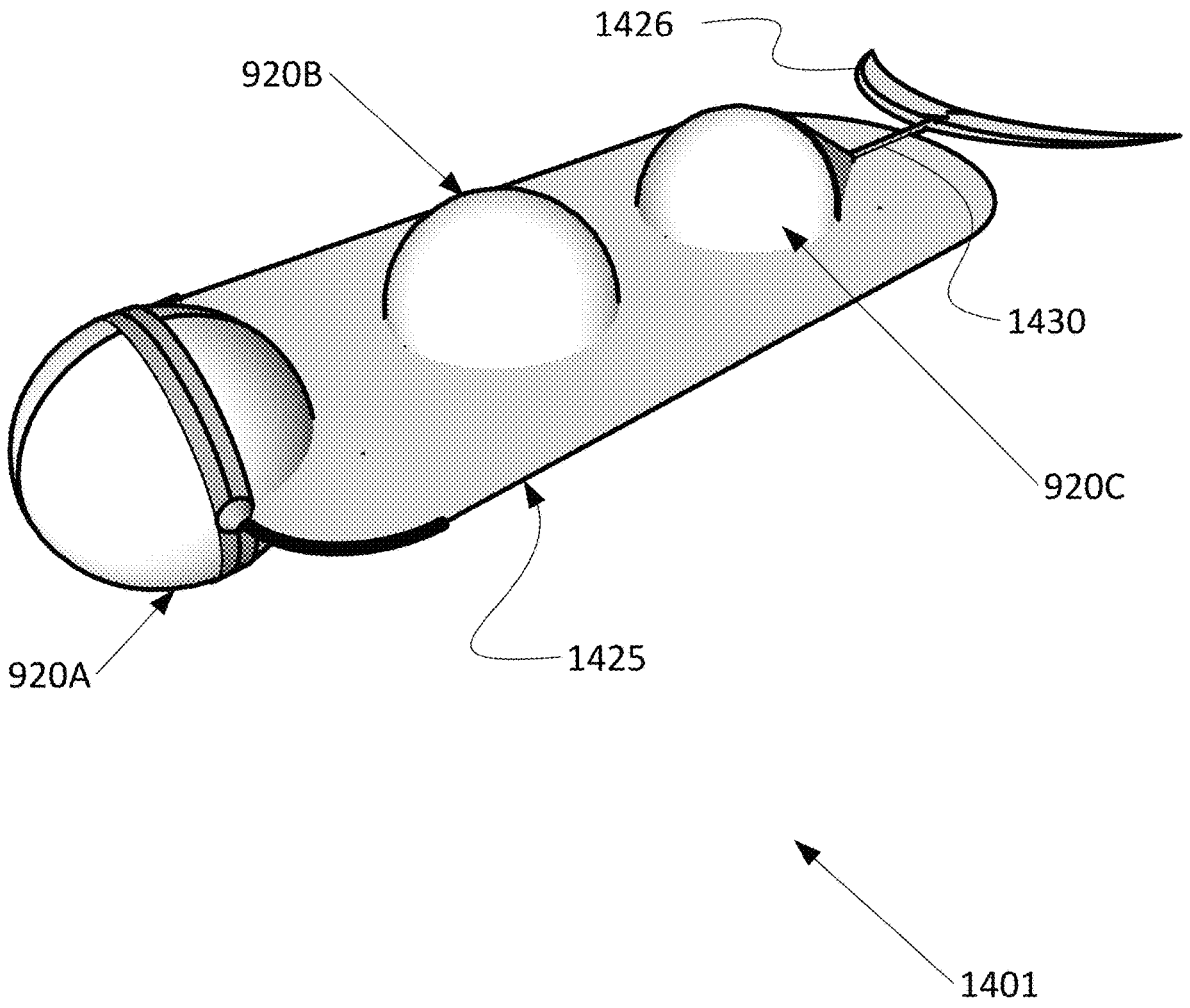
FIG. 14 illustrates an example of a robotic fish comprising three TREs, in accordance with an embodiment.

FIG. 14 illustrates an example of robotic fish 1401 comprising TRE 920A, TRE 920B, and TRE 920C, fin 1425, fin 1426, and tendon 1430 in accordance with an embodiment. As in FIG. 9, FIG. 10, FIG. 11, FIG. 12, and FIG. 13 TRE 920A, TRE 920B, and TRE 920C may be capable of producing fin torque angles of rotation which are perpendicular to a perimeter of fin 1425, which are tangent to the perimeter of fin 1425, a combination thereof, or which comprise a third fin torque angle of rotation. An electronic motor control module of robotic fish 1401 may drive one of TRE 920A, TRE 920B, and TRE 920C to precede or follow another TRE, such as by controlling a relative phase, frequency, or power of torque transfer between a first group and a second group within each TRE. A first wave produced by TRE 920A, a second wave produced by TRE 920B, and a third wave produced by TRE 920C may interfere to produce a fourth wave, e.g. a drive wave in fin 1425 and or fin 1426. In this manner, an electronic motor control module of robotic fish 1401 may produce a drive wave in fin 1425 and or fin 1426, a thrust vector on robotic fish 1401, and may change an orientation of the drive wave and thrust vector, such as to propel and or steer robotic fish 1401. A streamlined fairing may span around TRE 920A, TRE 920B, and TRE 920C to smooth flow of thrust fluid around robotic fish 1401. One or more tendons may be embedded within or around fin 1425. Tendon 1430 may be secured to TRE 920C.

Figure 15:
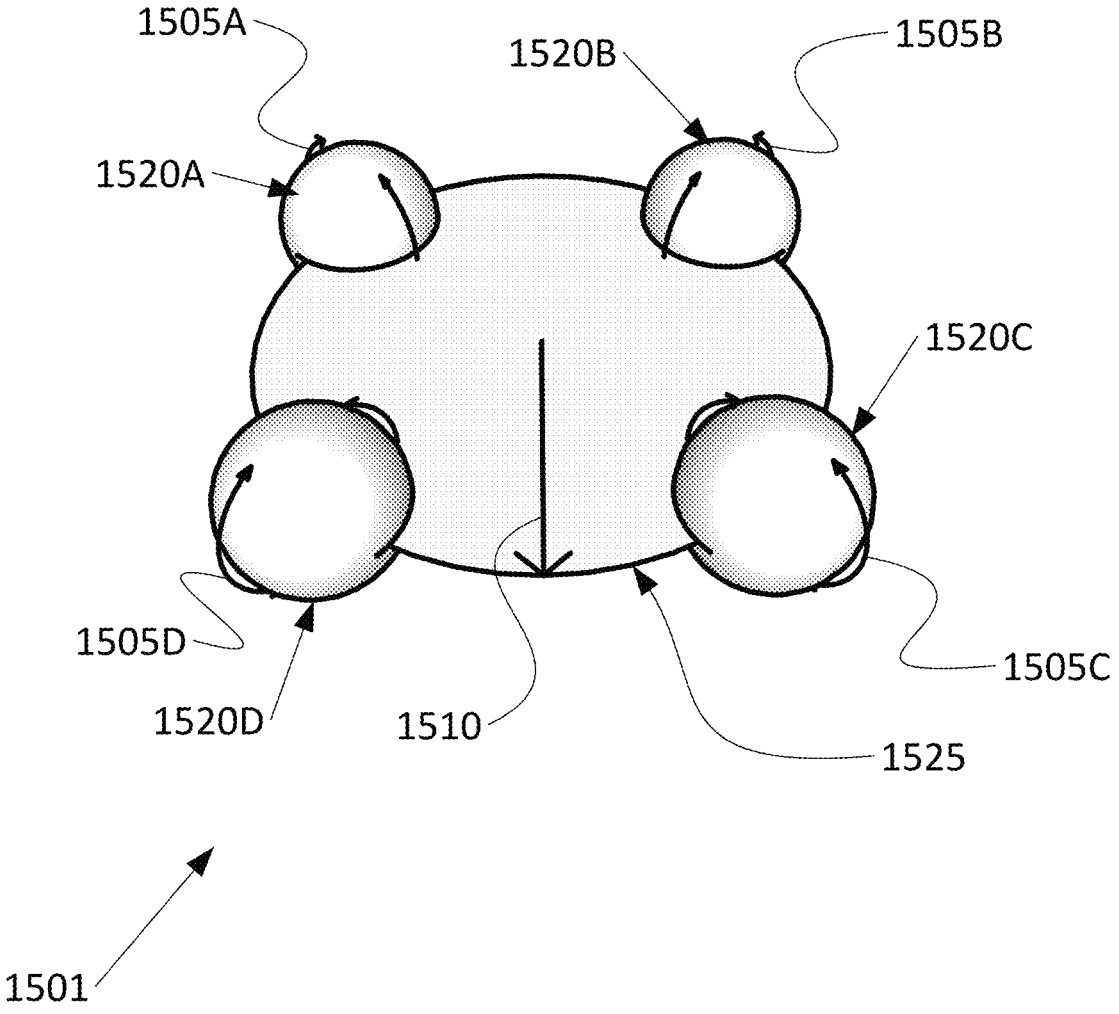
FIG. 15 illustrates an example of a robotic fish comprising four TREs, in accordance with an embodiment.

FIG. 15 illustrates an example of robotic fish 1501 comprising four TREs, TRE 1520A, TRE 1520B, TRE 1520C, and TRE 1520D, and fin 1525, in accordance with an embodiment. As in FIG. 9, FIG. 10, FIG. 11, FIG. 12, FIG. 13, and FIG. 14, TRE 1520A, TRE 1520B, TRE 1520C, and TRE 1520D may be capable of producing fin torque angles of rotation which are perpendicular to an edge of fin 1525, which are tangent to an edge of fin 1525, a combination thereof, or which comprise a third fin torque angle of rotation. However, the orientation of the first group and the second group within TRE 1520A, TRE 1520B, TRE 1520C, and TRE 1520D may be fixed. As illustrated in FIG. 15, TRE 1520A, TRE 1520B, TRE 1520C, and TRE 1520D may be capable of only producing fin torque angles of rotation 1505A, 1505B, 1505C, and 1505D, which are perpendicular to an edge of fin 1525. An electronic motor control module of robotic fish 1501 may drive one or more of TRE 1520A, TRE 1520B, TRE 1520C, and TRE 1520D to precede or follow another TRE, such as by controlling a relative phase, frequency, or power of torque transfer between a first group and a second group within each TRE. A first wave produced by TRE 1520A, a second wave produced by TRE 1520B, a third wave produced by TRE 1520C, and a fourth wave produced by TRE 1520D may interfere to produce a fifth wave, e.g. drive wave 1510 in fin 1525 (the illustrated orientation of drive wave 1510 is an example). In this manner, an electronic motor control module of robotic fish 1501 may produce drive wave in fin 1525, a thrust vector on robotic fish 1501, and may change an orientation of the drive wave and thrust vector, such as to propel and or steer robotic fish 1501. Robotic fish 1501 may be highly maneuverable, capable of changing orientation of the drive wave and thrust vector, without changing a fin torque angle of rotation of one or more of TRE 1520A, TRE 1520B, TRE 1520C, and TRE 1520D. A streamlined fairing may span around TRE 1520A, TRE 1520B, TRE 1520C, and TRE 1520D, to smooth flow of thrust fluid around robotic fish 1501. One or more tendons may be embedded within or around fin 1225.

Figure 16:
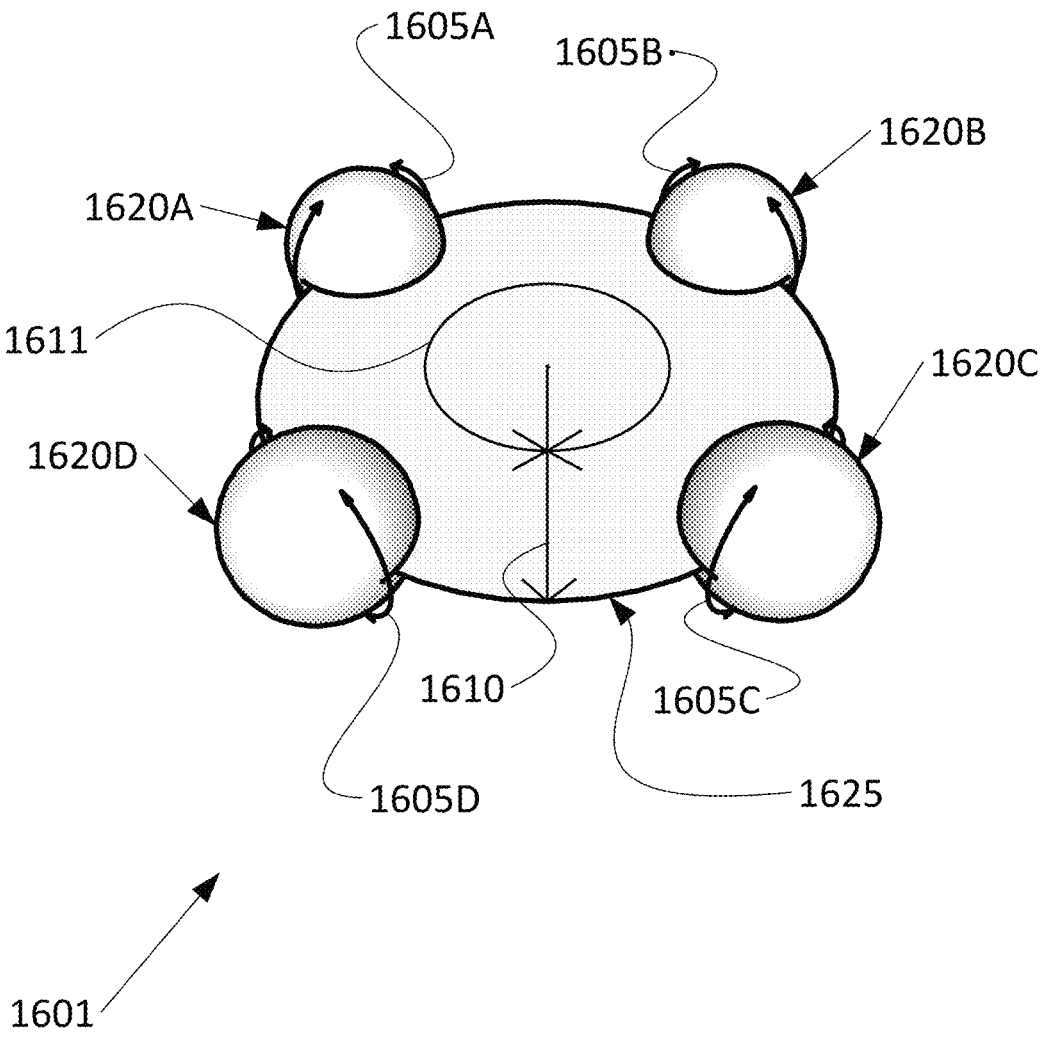
FIG. 16 illustrates an example of a robotic fish comprising four TREs, in accordance with an embodiment.

FIG. 16 illustrates an example of robotic fish 1601 comprising four TREs, TRE 1620A, TRE 1620B, TRE 1620C, and TRE 1620D, and fin 1625, in accordance with an embodiment. As in FIG. 9, FIG. 10, FIG. 11, FIG. 12, FIG. 13, FIG. 14, and FIG. 15, TRE 1620A, TRE 1620B, TRE 1620C, and TRE 1620D may be capable of producing fin torque angles of rotation which are perpendicular to an edge of fin 1625, which are tangent to an edge of fin 1625, a combination thereof, or which comprise a third fin torque angle of rotation. However, the orientation of the first group and the second group within TRE 1620A, TRE 1620B, TRE 1620C, and TRE 1620D may be fixed. As illustrated in FIG. 16, TRE 1620A, TRE 1620B, TRE 1620C, and TRE 1620D may be capable of only producing fin torque angles of rotation 1605A, 1605B, 1605C, and 1605D, which are tangent to an edge of fin 1625. An electronic motor control module of robotic fish 1601 may drive one or more of TRE 1620A, TRE 1620B, TRE 1620C, and TRE 1620D to precede or follow another TRE, such as by controlling a relative phase, frequency, or power of torque transfer between a first group and a second group within each TRE.

A first wave produced by TRE 1620A, a second wave produced by TRE 1620B, a third wave produced by TRE 1620C, and a fourth wave produced by TRE 1620D may interfere to produce a fifth wave, e.g. drive wave 1610 in fin 1625 (the illustrated orientation of drive wave 1610 is an example) and or drive wave 1611 in fin 1625. Drive wave 1611 may rotate robotic fish 1601 within surrounding thrust fluid this manner, including around a center of fin 1625. An electronic motor control module of robotic fish 1601 may produce drive wave in fin 1625, a thrust vector on robotic fish 1601, and may change an orientation of the drive wave and thrust vector, such as to propel, steer, or rotate robotic fish 1601. Robotic fish 1601 may be highly maneuverable, capable of changing orientation of the drive wave and thrust vector, without changing a fin torque angle of rotation of one or more of TRE 1620A, TRE 1620B, TRE 1620C, and TRE 1620D. A streamlined fairing may span around TRE 1620A, TRE 1620B, TRE 1620C, and TRE 1620D, to smooth flow of thrust fluid around robotic fish 1601. One or more tendons may be embedded within or around fin 1625.

Figure 17:
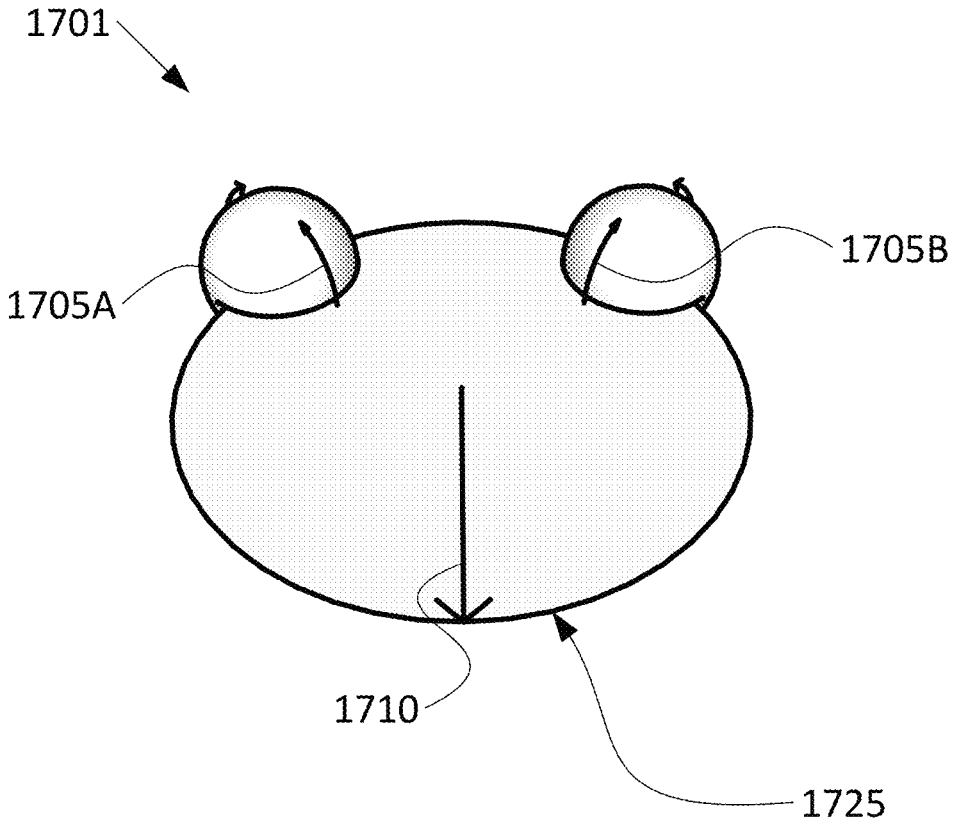
FIG. 17 illustrates an example of a robotic fish comprising two TREs, in accordance with an embodiment.

FIG. 17 illustrates an example of robotic fish 1701 comprising two TREs, TRE 1720A and TRE 1720B, and fin 1725, in accordance with an embodiment. As in FIG. 9, FIG. 10, FIG. 11, FIG. 12, FIG. 13, FIG. 14, FIG. 15, and FIG. 16, TRE 1720A and TRE 1720B may be capable of producing fin torque angles of rotation which are perpendicular to an edge of fin 1725, which are tangent to an edge of fin 1725, a combination thereof, or which comprise a third fin torque angle of rotation. However, the orientation of the first group and the second group within TRE 1720A and TRE 1720B may be fixed. As illustrated in FIG. 15, TRE 1720A and TRE 1720B may be capable of only producing fin torque angles of rotation 1705A and 1705B which are perpendicular to an edge of fin 1525. An electronic motor control module of robotic fish 1701 may drive one or more of TRE 1720A and TRE 1720B to precede or follow the other TRE, such as by controlling a relative phase, frequency, or power of torque transfer between a first group and a second group within each TRE. A first wave produced by TRE 1720A and a second wave produced by TRE 1720B may interfere to produce a third wave, e.g. drive wave 1710 in fin 1525 (the illustrated orientation of drive wave 1710 is an example). In this manner, an electronic motor control module of robotic fish 1701 may produce drive wave in fin 1725, a thrust vector on robotic fish 1701, and may change an orientation of the drive wave and thrust vector, such as to propel and or steer robotic fish 1701. Robotic fish 1701 may be more streamlined than robotic fish comprising more TREs. A streamlined fairing may span around TRE 1720A and TRE 1720B, to smooth flow of thrust fluid around robotic fish 1701. One or more tendons may be embedded within or around fin 1725.

Figure 18:
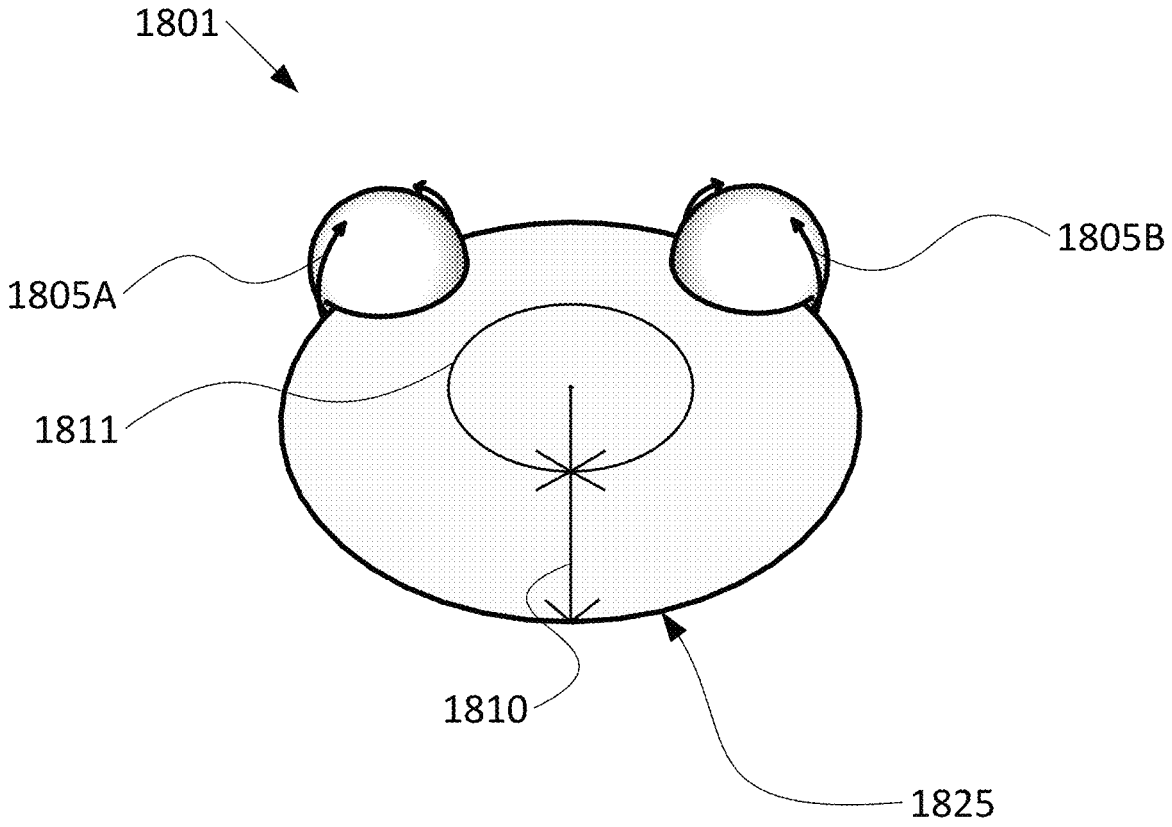
FIG. 18 illustrates an example of a robotic fish comprising two TREs, in accordance with an embodiment.

FIG. 18 illustrates an example of robotic fish 1801 comprising two TREs, TRE 1820A and TRE 1820B, and fin 1825, in accordance with an embodiment. As in FIG. 9, FIG. 10, FIG. 11, FIG. 12, FIG. 13, FIG. 14, FIG. 15, FIG. 16, and FIG. 17, TRE 1820A and TRE 1820B may be capable of producing fin torque angles of rotation which are perpendicular to an edge of fin 1825, which are tangent to an edge of fin 1825, a combination thereof, or which comprise a third fin torque angle of rotation. However, the orientation of the first group and the second group within TRE 1820A and TRE 1820B may be fixed. As illustrated in FIG. 18, TRE 1820A and TRE 1820B may be capable of only producing fin torque angles of rotation 1805A and 1805B, which are tangent to an edge of fin 1825. An electronic motor control module of robotic fish 1801 may drive one or more of TRE 1820A and TRE 1820B to precede or follow another TRE, such as by controlling a relative phase, frequency, or power of torque transfer between a first group and a second group within each TRE. A first wave produced by TRE 1820A and a second wave produced by TRE 1820B may interfere to produce a third wave, e.g. drive wave 1810 in fin 1825 (the illustrated orientation of drive wave 1810 is an example) and or drive wave 1811 in fin 1825. Drive wave 1811 may rotate robotic fish 1801 within surrounding thrust fluid this manner, including around or close to a center of fin 1825. An electronic motor control module of robotic fish 1801 may produce drive wave in fin 1825, a thrust vector on robotic fish 1801, and may change an orientation of the drive wave and thrust vector, such as to propel, steer, or rotate robotic fish 1801. Robotic fish 1801 may be maneuverable, capable of changing orientation of the drive wave and thrust vector, without changing a fin torque angle of rotation of one or more of TRE 1820A and TRE 1820B. Robotic fish 1801 may be more streamlined than robotic fish comprising more TREs. A streamlined fairing may span around TRE 1820A and TRE 1820B, to smooth flow of thrust fluid around robotic fish 1801. One or more tendons may be embedded within or around fin 1825.

Figure 19:
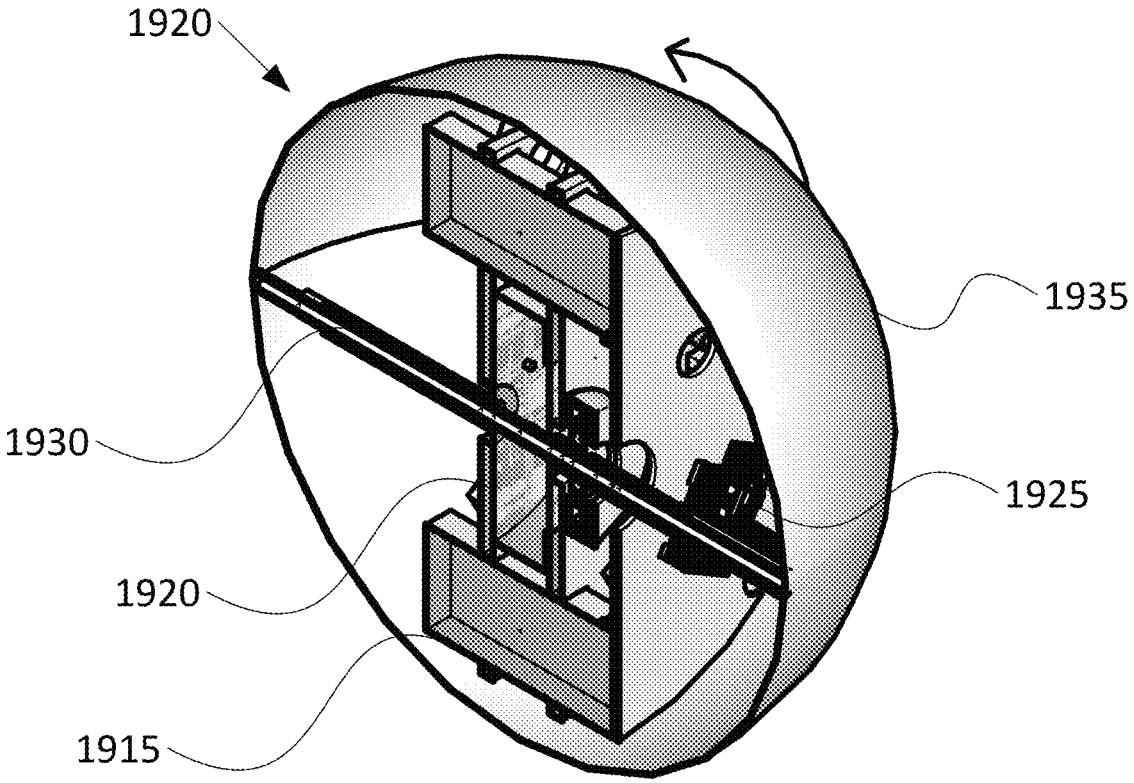
FIG. 19 illustrates an example of a TRE with a section view, in accordance with an embodiment.

FIG. 19 illustrates an example of TRE 1920 with a section view, in accordance with an embodiment. TRE 1920 is illustrated as comprising driveshaft 1930, batteries or inertial mass 1915, motor 1920, and electronic motor control module 1925, within isolation chamber 1935. An annular ring or gimbal may allow driveshaft 1930 be re-positioned within isolation chamber 1935. The first group within motor 1920 may be secured to driveshaft 1930 while the second group within motor 1920 may be secured to batteries or inertial mass 1915. Driveshaft 1930 and or isolation chamber 1935 may be secured to a fin. A bearing may be between the first group and the second group. An induction charging system may allow batteries of batteries or inertial mass 1915 to be recharged. As discussed herein, driveshaft 1930 is optional and may be removed, in which case a bearing, as discussed herein, may nonetheless still be between the first group and the second group. Electronic motor control module 1925 may energize electromagnets of the second group to transfer torque between the first group and the second group.

Figure 20:
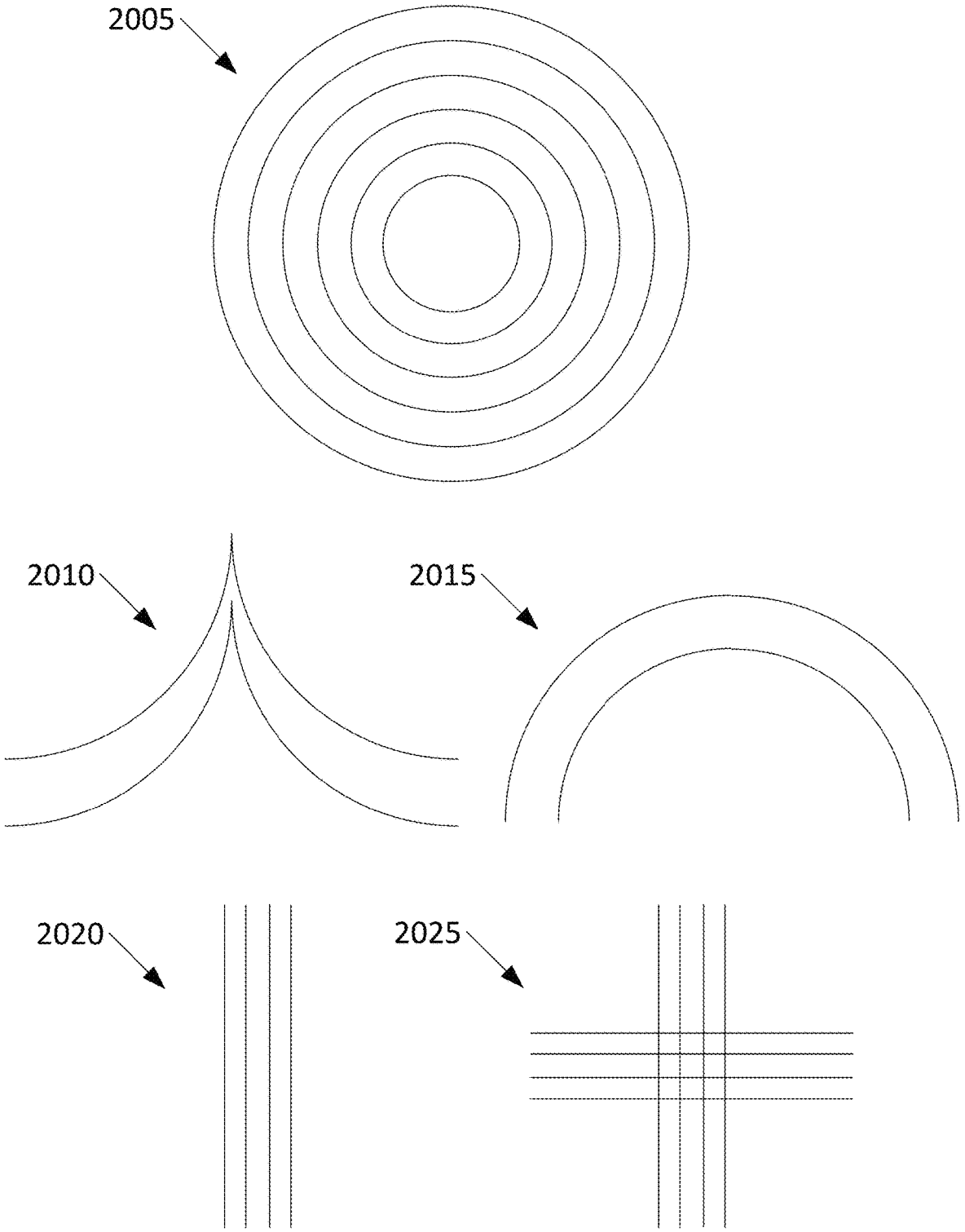
FIG. 20 illustrates examples of tendon arrangements, in accordance with an embodiment.

FIG. 20 illustrates examples of tendon arrangements, in accordance with an embodiment. Tendon arrangement 2005 comprises concentric rings. Tendon arrangement 2010 comprises curvalinear chevrons. Tendon arrangement 2015 comprises concentric ring segments. Tendon arrangement 2020 comprises straight segments. Tendon arrangement 2025 comprises two overlapping sets of straight segments. Other tendon arrangements are possible.

Embodiments of the operations described herein may be implemented in a computer-readable storage device having stored thereon instructions that when executed by one or more processors perform the methods. The processor may include, for example, a processing unit and/or programmable circuitry. The storage device may include a machine readable storage device including any type of tangible, non-transitory storage device, for example, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of storage devices suitable for storing electronic instructions. USB (Universal serial bus) may comply or be compatible with Universal Serial Bus Specification, Revision 2.0, published by the Universal Serial Bus organization, Apr. 27, 2000, and/or later versions of this specification, for example, Universal Serial Bus Specification, Revision 3.1, published Jul. 26, 2013. PCIe may comply or be compatible with PCI Express 3.0 Base specification, Revision 3.0, published by Peripheral Component Interconnect Special Interest Group (PCI-SIG), November 2010, and/or later and/or related versions of this specification.

As used in any embodiment herein, the term "logic" may refer to the logic of the instructions of an app, software, and/or firmware, and/or the logic embodied into a programmable circuitry by a configuration bit stream, to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices.

"Circuitry", as used in any embodiment herein, may comprise, for example, singly or in any combination, hard-wired circuitry, programmable circuitry such as FPGA. The logic may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc.

In some embodiments, a hardware description language (HDL) may be used to specify circuit and/or logic implementation(s) for the various logic and/or circuitry described herein. For example, in one embodiment the hardware description language may comply or be compatible with a very high speed integrated circuits (VHSIC) hardware description language (VHDL) that may enable semiconductor fabrication of one or more circuits and/or logic described herein. The VHDL may comply or be compatible with IEEE Standard 1076-1987, IEEE Standard 1076.2, IEEE1076.1, IEEE Draft 3.0 of VHDL-2006, IEEE Draft 4.0 of VHDL-2008 and/or other versions of the IEEE VHDL standards and/or other hardware description standards.

In this way, a TRE in which a second group comprising electromagnets, an inertial mass, and batteries floats within a first group comprising electromagnets secured to a fin, may comprise no driveshaft and may achieve one, two, or three torque angles of rotation. In this way, a TRE with a driveshaft may achieve one, two, or three torque angles of rotation with a gimbal. In this way, a robotic fish may have a fin in a form of a flagellum. In this way a robotic fish may comprise a plurality of TREs secured to a fin, wherein the plurality of TREs each produce a wave in the fin, the plurality of waves interfere to produce a drive wave, wherein the drive way may one of propel, steer, or rotate the robotic fish in surrounding thrust fluid. In this way, a robotic fish comprising two to four or more TREs may function in water in a comparable way to how quadcopter drones function in air.

The invention claimed is:

1. A robotic fish comprising a fin and one or more torque reaction engines ("TREs") secured to the fin, wherein the one or more TREs are to cause the fin to translate or rotate through and transfer momentum to a surrounding thrust fluid, wherein the one or more TREs comprise a first set of magnets, a second set of magnets, and an inertial mass, wherein at least one of the first set of magnets and the second set of magnets are electronically controlled by an electronic motor control module to transfer a torque between a first group and a second group, wherein the first group comprises the first set of magnets and the fin and the second group comprises the second set of magnets and the inertial mass, wherein the second group floats within the first group on a bearing, wherein the bearing comprises a bearing surface of a closed ball-and-socket joint.

2. The robotic fish according to claim 1, wherein the bearing surface of the closed ball-and-socket joint further comprises at least one of a magnetic bearing on a rolling bearing.

3. The robotic fish according to claim 2, wherein the rolling bearing comprises a bearing cage.

4. The robotic fish according to claim 2, wherein the magnetic bearing comprises a permanent magnet and an electromagnet, and wherein to float comprises the permanent magnet suspending the second group in a desired position within the first group and the electromagnet correcting deviations of the second group from a desired position and transferring the torque between the first group and the second group.

5. The robotic fish according to claim 1, wherein to electronic control comprises to pass an electric current through an electromagnet to produce a magnetic field, wherein the magnetic field is to transfer the torque between the first group and the second group.

6. The robotic fish according to claim 1, wherein transfer of the torque between the first group and the second group produces a fin torque on the first group and an engine torque on the second group, wherein the fin torque is to cause the fin to translate or rotate through and transfer momentum to the surrounding thrust fluid.

7. The robotic fish according to claim 6, wherein the fin torque and the engine torque have opposing vectors.

8. The robotic fish according to claim 6, wherein the engine torque comprises an engine torque angle of rotation.

9. The robotic fish according to claim 8, wherein the engine torque angle of rotation is a first engine torque angle of rotation and the engine torque further comprises at least one of a second engine torque angle of rotation and a third engine torque angle of rotation.

10. The robotic fish according to claim 9, wherein the first engine torque angle of rotation and at least one of the second engine torque angle of rotation and the third engine torque angle of rotation produce the fin torque, wherein the fin torque comprises a first fin torque angle of rotation and at least one of a second fin torque angle of rotation and a third fin torque angle of rotation, and wherein fin torque is to cause the fin to translate or rotate through and transfer momentum to the surrounding thrust fluid along the first fin torque angle of rotation and at least one of the second fin torque angle of rotation and the third fin torque angle of rotation.

11. The robotic fish according to claim 10, wherein the first fin torque angle of rotation and at least one of a second fin torque angle of rotation and a third fin torque angle of rotation produce a spiral path of the fin through the surrounding thrust fluid.

12. The robotic fish according to claim 6, wherein the fin torque on the first group is to cause the fin to translate or rotate through and transfer momentum to the surrounding thrust fluid along a fin torque angle of rotation.

13. The robotic fish according to claim 1, wherein the fin spans between the one or more TREs and wherein the electronic motor control module is to drive a first TRE in the one or more TREs to thereby drive a first portion of the fin and the electronic motor control module is further to drive a second TRE in the one or more TREs to thereby drive a second portion of the fin.

14. The robotic fish according to claim 13, wherein the electronic motor control module is to drive the second TRE in the one or more TREs to drive the second portion of the fin to precede or follow the first portion of the fin.

15. The robotic fish according to claim 14, further comprising a third TRE in the one or more TREs and wherein the electronic motor control module is to drive the first TRE in the one or more TREs, the second TRE in the one or more TREs, and the third TRE in the one or more TREs, to generate a plurality of waves in the fin, wherein the plurality of waves are to interfere and form a drive wave, wherein the drive wave is to cause the fin to translate or rotate through and transfer momentum to the surrounding thrust fluid along a drive wave thrust vector, wherein the drive wave thrust vector is to at least one of propel the robotic fish through the surrounding thrust fluid or to rotate the robotic fish in the surrounding thrust fluid.

16. The robotic fish according to claim 1, wherein a first of the one or more TRE is to cause a wave to propagate through the fin, wherein the wave is to cause the fin to translate or rotate through and transfer momentum to the surrounding thrust fluid.

17. The robotic fish according to claim 16, the wave is a first wave and wherein a second of the one or more TRE is to cause a second wave to propagate through the fin.

* * * * *